US011089849B2

(12) United States Patent
Granito

(10) Patent No.: US 11,089,849 B2
(45) Date of Patent: Aug. 17, 2021

(54) BRACELET CLASP INCLUDING A DEVICE FOR ADJUSTING THE LENGTH OF THE BRACELET

(71) Applicant: DEXEL S.A., Bienne (CH)

(72) Inventor: Elio Granito, Bern (CH)

(73) Assignee: DEXEL SA, Bienne (CH)

( * ) Notice: Subject to any disclaimer, the term of this patent is extended or adjusted under 35 U.S.C. 154(b) by 285 days.

(21) Appl. No.: 16/076,045

(22) PCT Filed: Feb. 24, 2017

(86) PCT No.: PCT/EP2017/054412
§ 371 (c)(1),
(2) Date: Aug. 7, 2018

(87) PCT Pub. No.: WO2017/144704
PCT Pub. Date: Aug. 31, 2017

(65) Prior Publication Data

US 2019/0380456 A1 Dec. 19, 2019

(30) Foreign Application Priority Data

Feb. 25, 2016 (EP) ..... 16157398

(51) Int. Cl.
*A44C 5/24* (2006.01)

(52) U.S. Cl.
CPC ..... *A44C 5/246* (2013.01); *Y10T 24/2155* (2015.01); *Y10T 24/4782* (2015.01)

(58) Field of Classification Search
CPC ..... Y10T 24/4782; Y10T 24/2413; Y10T 24/2155; A44C 5/18; A44C 5/22; A44C 5/24; A44C 5/246
See application file for complete search history.

(56) References Cited

U.S. PATENT DOCUMENTS 5,771,543 A 6/1998 Froidevaux et al.
8,001,658 B2 * 8/2011 Christian ..... A44C 5/246 24/71 J
8,789,245 B2 7/2014 Leger
(Continued)

FOREIGN PATENT DOCUMENTS

CH 700230 A2 7/2010
CH 704335 A1 7/2012
(Continued)

*Primary Examiner* — Robert Sandy
*Assistant Examiner* — Michael S Lee
(74) *Attorney, Agent, or Firm* — Robert C. Netter, Jr.; Dann, Dorfman, Herrell & Skillman

(57) ABSTRACT

The invention relates to a bracelet clasp, in particular for a wristwatch, comprising a device for fine length adjustment of the bracelet. In one embodiment, the invention relates to a clasp with extensible buckle, and the adjustment device is provided on a blade intended for being inserted between two posts of a main blade when the clasp is closed. The adjustment device includes a locking pin, arranged in an orthogonal direction relative to the longitudinal direction of the clasp and housed so that at least one portion of the pin is provided above a common upper surface of the blades of the clasp. In one embodiment, the mobile piece of the adjustment device is pivotably mounted on the clasp.

17 Claims, 14 Drawing Sheets

(56) References Cited

U.S. PATENT DOCUMENTS

| | | | | |
|---|---|---|---|---|
| 2007/0125123 | A1* | 6/2007 | Sierro | A44C 5/246 63/3.2 |
| 2014/0130545 | A1 | 5/2014 | Leger | |
| 2021/0022457 | A1* | 1/2021 | Schaller | A44C 5/246 |

FOREIGN PATENT DOCUMENTS

| | | | |
|---|---|---|---|
| CH | 705149 | A1 | 12/2012 |
| EP | 0819391 | A1 | 1/1998 |
| EP | 2452583 | A1 | 5/2012 |

* cited by examiner

BRACELET CLASP INCLUDING A DEVICE FOR ADJUSTING THE LENGTH OF THE BRACELET

This application is a § 371 application of PCT/EP2017/054412, filed Feb. 24, 2017, which claims priority to European Patent Application No. 16157398.5, filed Feb. 25, 2016. The entire disclosure of each of the foregoing applications is incorporated by reference herein.

TECHNICAL FIELD

The present invention relates to the field of bracelets, especially for watches. It relates to a bracelet clasp that can be used to adjust the length of the bracelet. The invention also relates to a length-adjustment device and a wristwatch including the clasp and/or the length-adjustment device.

PRIOR ART AND PROBLEMS THAT GAVE RISE TO THE INVENTION

A wristwatch clasp generally comprises two attachment members for securing the free ends of the bracelet, and a locking or closing mechanism for blocking the two attachment members, and thus the free ends of the bracelet, in a stable closed or locked position. This position also constitutes the service position, since it allows the wristwatch to be worn on the wrist. There are many types of clasps, for example tongue buckles or extensible buckle clasps, which are aesthetically pleasing.

Wristwatch clasps or bracelets generally include means for adjusting the length of the bracelet. Typically, in the case of leather or plastic bracelets, the free end of one of the two strands of the bracelet includes a series of holes distributed along the longitudinal direction of the bracelet. The free end of the other bracelet strand is provided with a connection device, for example a tongue buckle, allowing the two strands to be connected by inserting the tongue into the hole corresponding to the desired length. In the case of bracelets with metal links, the length of the bracelet is adjusted by removing or adding a link to one or both of the strands of the bracelet.

Wristwatch clasps that allow fine adjustment of the length of the bracelet are known in the prior art. Such a fine adjustment is desirable for precisely adapting the length of the bracelet to the wrist of the wearer. In addition, as mentioned in document CH704335, the size of a wearer's wrist can vary with temperature changes, for example. The same wearer can thus regularly want to finely adjust the length of the bracelet in order to be perfectly comfortable.

Fine length adjustment is generally designed to make it possible to adjust the length of the bracelet until a maximum distance which is defined by the mechanism for coarse length adjustment. According to the type of clasp, this distance can correspond to the size of the links, or else to the distance between holes in the bracelet strand. The fine adjustment device is preferably arranged so as to allow the length to be adjusted with a precision defined by the discrete distances of the fine adjustment serration over the entire adjustable distance of the bracelet. In practice, fine adjustment can often be carried out along a total distance of 3 to 10 mm, at intervals of 1 to 2.5 mm, for example.

The fine adjustment device of a bracelet clasp generally includes a mobile part arranged on a portion of the clasp and supporting one of the two attachment members, the other attachment member being secured to another portion of the clasp. The fine adjustment can be made by moving the mobile part relative to the whole of the clasp, and by blocking same in the position corresponding to the desired bracelet length. The fine adjustment device often includes a serration or a toothed portion, which defines discrete fine adjustment length positions. The serration can also be part of the mechanism that allows the mobile part to be locked in a desired length position.

Document CH704335 discloses an extensible buckle clasp, wherein an attachment member is secured to a carriage provided to slide in a recess arranged on a blade of the clasp. The clasp also comprises a pull stud arranged such as to engage with the carriage, and likely to occupy two axial positions in order for the carriage to be locked and unlocked when the pull stud is in either one of the two axial positions, respectively. One drawback of this mechanism is the fact that at least one of the two opposing push members of the pull stud protrudes relative to the side walls of the blade of the clasp. The protruding push member is likely to catch on an external object, for example a garment.

As mentioned in documents CH704335, EP2452583 and CH700230, it may be desirable for the length of a bracelet to be adjustable regardless of the state—closed or open—of the clasp.

Another aim is to provide a clasp that is completely separate and independent from the closing mechanism of the clasp, or else a length-adjustment device that can be associated with any type of clasp, whether an extensible buckle clasp, a tongue buckle clasp, or another type of bracelet clasp.

One aim of the invention is also to implement a clasp that is generally aesthetically pleasing. In this regard, a clasp with a discreet adjustment mechanism that integrates into the general shape of the clasp may be desirable. For example, one aim consists of avoiding the presence of serrations visible from the outside or longitudinal openings provided along a side wall of a shape of an extensible buckle clasp.

SUMMARY OF THE INVENTION

According to one aspect, the present invention relates to a bracelet clasp of the type comprising first and second free ends, the clasp including first and second attachment members of the bracelet intended for being connected to said first and second free ends of the bracelet, respectively.

According to one aspect, the present invention relates to an extensible buckle clasp for a bracelet allowing the length of a bracelet to be adjusted, said clasp including: a first blade and a second blade, hingedly connected relative to one another at a first end, the first blade including two side posts between which a space is formed likely to receive said second blade when the clasp is in a closed position; locking means making it possible to maintain said first and second blades in said closed position; and a device for adjusting the length of the bracelet.

According to one aspect, the present invention relates to an extensible buckle clasp for a bracelet allowing the length of a bracelet to be adjusted, said clasp including:

- a first blade and a second blade, hingedly connected relative to one another at a first end, the first blade including two side posts between which a space is formed likely to receive said second blade when the clasp is in a closed position;
- locking means making it possible to maintain said first and second blades in said closed position;
- a device for adjusting the length of the bracelet, said adjustment device including a locking element, a housing for the locking element, and a mobile piece to which a first attachment member is secured, said attachment member being intended for being connected to a first free end of the bracelet; characterized in that said length-adjustment device is connected to said second blade, arranged to be received in said space formed between said side posts of said first blade when the clasp is in a closed position. Said housing for said locking element is preferably arranged so that at least one portion of the locking element is located above said first blade when the clasp is in a closed position.

According to one aspect, the present invention relates to a bracelet clasp of the type comprising first and second free ends, the clasp including first and second attachment members of the bracelet intended for being connected to said first and second free ends, respectively, of the bracelet, said attachment members being movable relative to one another between at least an open position and a closed service position, wherein they are closer to one another than in the open position, the clasp comprising:

locking means that make it possible to open and close the clasp;

a first support having a device for adjusting the length of the bracelet, said adjustment device including a mobile piece to which one of the two attachment members is secured, characterized in that said mobile piece is pivotably mounted on said first support.

Other aspects and preferred embodiments of the invention are defined in the claims and in the description hereunder.

BRIEF DESCRIPTION OF THE DRAWINGS

The features and advantages of the invention will appear more clearly upon reading a description of two preferred embodiments, given only by way of non-limiting example, in reference to the diagrammatic figures in which.

DESCRIPTION OF THE EMBODIMENTS

The present invention relates to a clasp, in particular a bracelet clasp. According to a preferred embodiment, the invention relates to a timepiece bracelet clasp, preferably for a wristwatch. The bracelet can be of any type, for example made of flexible plastic material, leather or comprising an assembly of links, for example made of metal.

Generally speaking, the bracelet consists of two longitudinal bracelet portions, respectively in the form of first and second strands (not shown), and each of the strands is such that one of the ends thereof is connected to the case of the watch while the other is intended for being secured to an attachment member of the clasp. As indicated below, in the case of a tongue buckle, the end of one of the two strands includes a series of holes, and the approximate or coarse length is adjusted by choosing the hole into which the tongue is inserted.

To describe the invention in reference to the figures, the expressions "length direction of the bracelet" or "longitudinal direction of the bracelet" are used to designate an axis which is that of the two bracelet strands, assuming that the bracelet is laid out flat and detached from a watch. When the bracelet is closed, the "length direction of the bracelet" designates the line that follows the perimeter of the bracelet. The bracelet length finely adjusted by the adjustment device of the clasp according to the invention is in the length direction of the bracelet. In the case of a wristwatch with a conventional dial, an axis connecting the numbers 6 and 12 of the dial generally follows the length direction of the bracelet according to the present definition.

Ignoring the device for locking the length-adjustment device, the clasp shown in the figures is substantially symmetrical and thus includes a plane which constitutes a plane of symmetry in the embodiments in which the clasp is perfectly symmetrical. According to the present description, this plane which extends in the length direction of the bracelet and the clasp is considered to be the "plane of symmetry", even if the symmetry of the clasp is not perfect, for example due to the positioning of the length-adjustment device and of the locking device thereof.

The term "orthogonal" relates to an axis that is perpendicular to the "length direction of the bracelet" and perpendicular to the plane of symmetry of the clasp. In the case of a wristwatch with a dial, an axis connecting the numbers 3 and 9 of the dial has an "orthogonal" direction according to the present definition.

Figure 4:
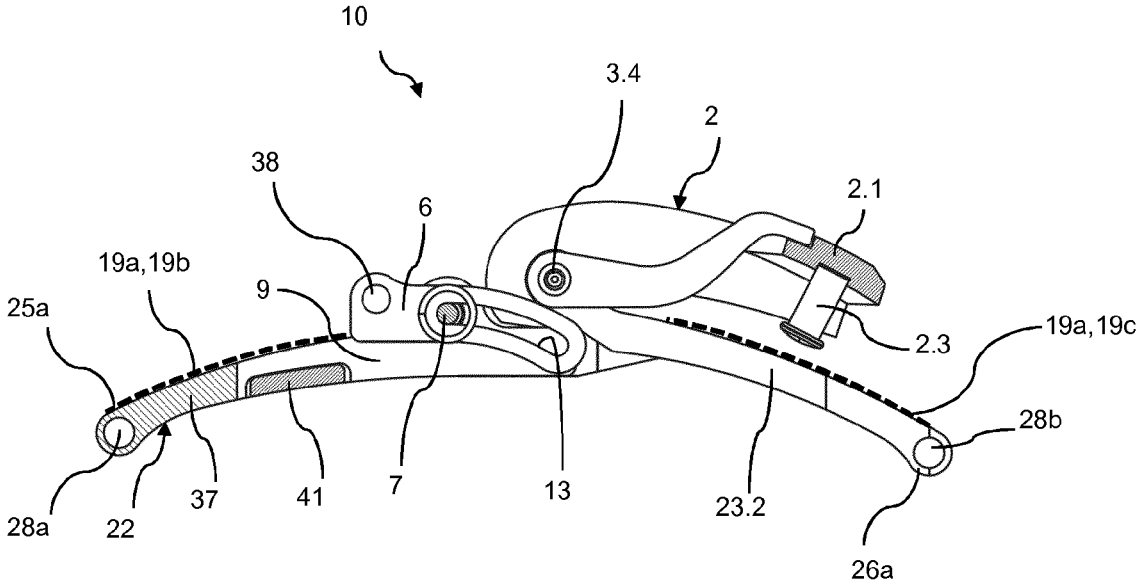
FIG. 4 is a longitudinal section side view of the clasp of FIGS. 1 to 3 shown in closed position.

A "radial" axis is an axis that is radial relative to the axis of the wrist or the forearm of a wristwatch wearer. The radial axis extends in the plane of symmetry or in a plane parallel to the plane of symmetry. In the view of FIG. 4, the "radial" axis is a substantially "vertical" axis, and the two terms are used interchangeably in the present description.

The terms "bottom" and "top" generally refer to the bottom and top, respectively, of the clasp as shown in FIG. 4. The expressions "below" and "above" should be understood similarly, the structural elements near the wrist being below the highest elements.

If the expressions "longitudinal direction of the bracelet", "orthogonal" and "radial" relate to the orientation of an element of the clasp or of an axis of said element, these expressions relate to the orientation of the element or the axis thereof when the clasp is closed.

According to one embodiment, the clasp of the invention is an extensible clasp, a fold-out clasp or an extensible buckle clasp. This type of clasp is known, for example, from patent documents EP 0913106, CH700230, EP2452583, EP2361523 and CH704335. The clasp includes at least two longitudinal clasp segments. In the present description, these longitudinal segments are also referred to as "the blades" of the clasp. A clasp generally comprises two or three longitudinal segments. The clasps shown in the figures are clasps with three blades 20, 22, 23. Evidently, it would be entirely possible to produce the clasp of the invention with an extensible buckle having two blades or even with a tongue buckle clasp only. It should be noted that the clasps shown in the figures combine the features of an extensible buckle clasp with a known bracelet strand attachment of the tongue buckle type. The present invention also contemplates tongue buckle type clasps only. A tongue buckle type clasp in the absence of an extensible buckle corresponds to an embodiment of the invention.

Indeed, a person skilled in the art will understand that the device for fine adjustment of bracelet length according to the invention can be adapted to any type of clasp and it not limited to a specific type of clasp.

Locking means for clasps with extensible blade are known per se. The locking mechanism 3 used in the clasps shown in the figures will be described quickly insofar as it does not constitute the core of the invention. In the embodiments shown, the clasp 10, 110 having three blades includes a central blade or a first blade 20 which comprises two side posts 21.1, 21.2, separated from one another by a transverse spacer 41 provided in a position between the two ends 24*a*, 24*b* of the central blade 20.

Figure 1:
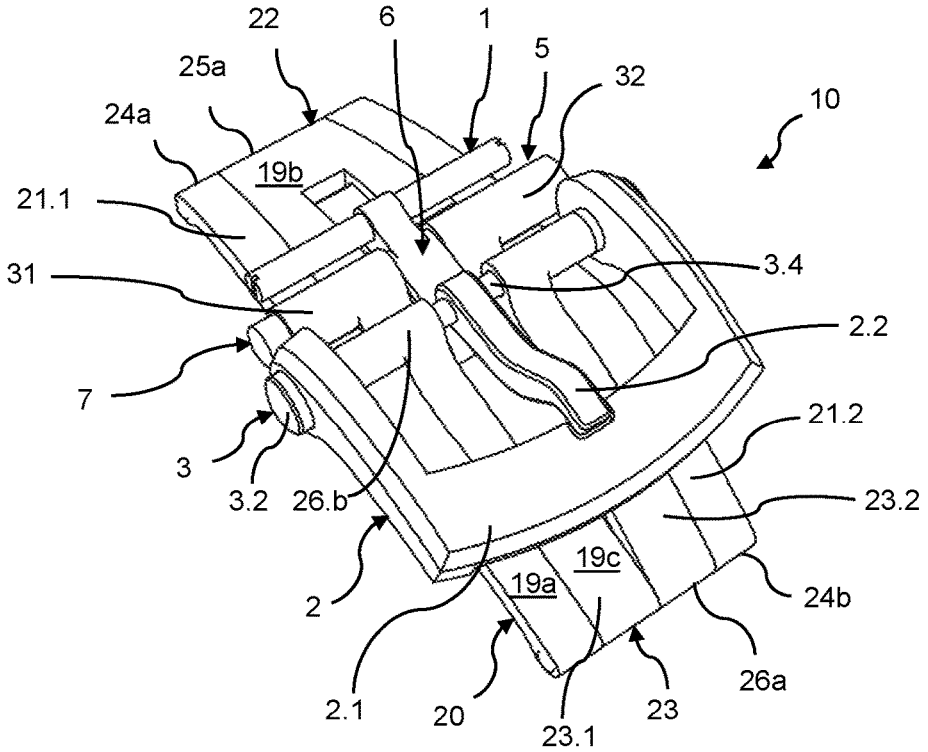
FIG. 1 is a perspective view of a bracelet clasp according to a first embodiment of the present invention. The clasp is shown in closed position.

The central blade 20 has an elongate shape in the longitudinal direction of the bracelet, slightly curved to better match the shape of a wearer's wrist. The central blade 20 comprises a lower surface, intended for being in contact with the wearer's wrist, and an upper surface 19*a*, visible in FIGS. 1-3. The upper surface can be visible from the outside when a wearer wears a wristwatch including the clasp. As will be described below, in a position with the clasp closed, the blades of the clasp form a common upper surface, mostly following the upper surface of the central blade 20.

A lateral blade 22, hereinafter also referred to as second blade 22 or inner blade, serves as a support for the device for fine length adjustment 5, 105. Hereinafter, this device will generally be referred to as "length-adjustment device" or else "adjustment device". The second blade 22 includes first and second opposite ends 25*a*, 25*b*. Towards the first end 25*a* thereof, the second blade 22 is pivotably hinged with the first end 24*a* of the central blade 20. The second end 25*b* of the second blade 22 of the clasp shown in the figures is free in that it is not hingedly connected to another blade of the clasp.

Another lateral blade 23, hereinafter also referred to as third blade, also includes first and second opposite ends 26*a*, 26*b*. The first end 26*a* of the third blade is pivotably mounted on the second end 24*b* of the central blade 20.

The two lateral blades 22 and 23 are thus hingedly connected towards the ends of the central blade 20 and between the side posts 21.1, 21.2, so as to be able to be inserted exactly into the space 40 formed therebetween by the transverse spacer 41, to define a closed clasp position, shown in FIGS. 1, 3, 4, 10, 12 and 13. The second blade 22 further comprises, on the lower face thereof, a niche 27 that will be occupied by the transverse spacer 41 when the second blade is lowered into the position thereof between the two side posts 21.1, 21.2.

It is understood that, in closed position, the side flanks 158, 159 (FIGS. 5, 9, 8B, 15 and 17 B) of the second blade 22 are aligned with and/or extend next to the inner side surfaces of the two side posts 21.1, 21.2 of the first blade 20.

The clasp of the invention preferably comprises locking means for keeping the clasp stable in the closed position, and for allowing the opening of the clasp. The present invention is not limited to any specific mechanism or locking device. The mechanical principle of the locking device shown in the drawings, referred to throughout by reference number 3 (FIG. 1), is known per se and will only be described briefly below. It will be noted that the third blade 23 is made up of two blade halves 23.1, 23.2 separated by a slot, the latter allowing a movement of the two blade halves towards one another along an orthogonal direction, perpendicular to the longitudinal direction of the clasp. The blade halves are, however, kept separated by a spring housed in hollow cylinders surrounding the pin 3.4 of the tongue buckle 2, which in turn constitutes an attachment member of a free end of a bracelet strand. The pin 3.4 is inserted into two coaxial tubes 3.5 having orthogonal axes and which are provided at the free ends of the blade halves 23.1, 23.2. The pin connects the two ends of the frame 2.1 of the tongue buckle so as to provide a hinge for the latter. Push members 3.2 are arranged on either side of the ends of the frame 2.1 of the tongue buckle, forming a lateral extension of the pin 3.4. They are held on an orthogonal axis, separated from one another by the aforementioned springs.

A wearer seeking to open the clasp 10 can press the push members 3.2 by holding them between the thumb and the index finger. The pressure on the push members 3.2 is transmitted to the blade halves 23.1, 23.2, the free ends of which are moved towards one another. This movement leads to a release of the reinforcements or hooks 3.1 (FIG. 2), provided on the sides of the blade halves 23.1, 23.2 from the respective seats thereof 3.3 arranged in the inner side surfaces of each of the posts 21.1 and 21.2 of the main blade 20.

To close the clasp, the wearer first makes sure that the second blade 22 is in folded position, in the space 40 formed between the side posts 21.1 and 21.2. The second blade contains ball ratchets 3.5 (FIG. 5) which engage with cavities made in the inner side faces of each of the posts 21.1 and 21.2, in order to prevent the second blade 22 from pivoting out of the lowered position when the wearer wants to close the clasp by holding the third blade 23. The wearer brings the third blade into the position with the clasp closed, for example by pressing on the third blade until the hooks 3.1 are in the respective seats 3.3 thereof. To do this, and according to the shape of the hooks and the seats thereof, it may be necessary to press on the pair of side push members 3.2 as when opening the clasp. Alternatively, the wearer simply needs to press on the third blade in a radial direction perpendicular to the general plane of the clasp in order to move the blade halves 23.1, 23.2 towards one another as required to bend the third blade until it is in the locked position. In the latter case, the closing can be carried out by a lock mechanism. It can also be mentioned that, in the closed clasp position, the free end 26*b* of the third blade 23 engages with the free end 25*b* of the second blade 22, so as to block same in the folded and closed position.

In one embodiment, when the clasp is in a closed clasp position, the upper surfaces of the first and second blades 20, 22 form a common upper surface 19*a*, 19*b*. The first and second blades 20, 22, are arranged so that at least part of the respective upper surfaces thereof 19*a*, 19*b* form a common and/or uniform surface when the clasp is closed. In other words, some of the upper surfaces 19*a* and 19*b* are in the same plane. This plane is preferably slightly curved, according to the general construction of the clasp, described above. In a longitudinal section of the clasp, along the axis of symmetry, as shown in FIG. 4, the common upper surface 19*a*, 19*b* of the first and second blades 20, 22 follows a single line, indicated by the dotted line in FIG. 4.

In a similar manner, the first and third blades 20, 23 are arranged so that at least part of the respective upper surfaces thereof 19*a*, 19*c* form a common and/or uniform surface when the clasp is in the closed position thereof. The common surface of the first and third blades 20, 23 is also indicated by dotted lines in FIG. 4.

The aforementioned arrangement is the result of inserting the lateral blades 22, 23 into the space 40 arranged between the two side posts 21.1, 21.2 of the central blade 20, making it possible to provide an attractive, harmonious appearance, while economizing the space along the radial axis and to produce a thin clasp.

Figure 13:
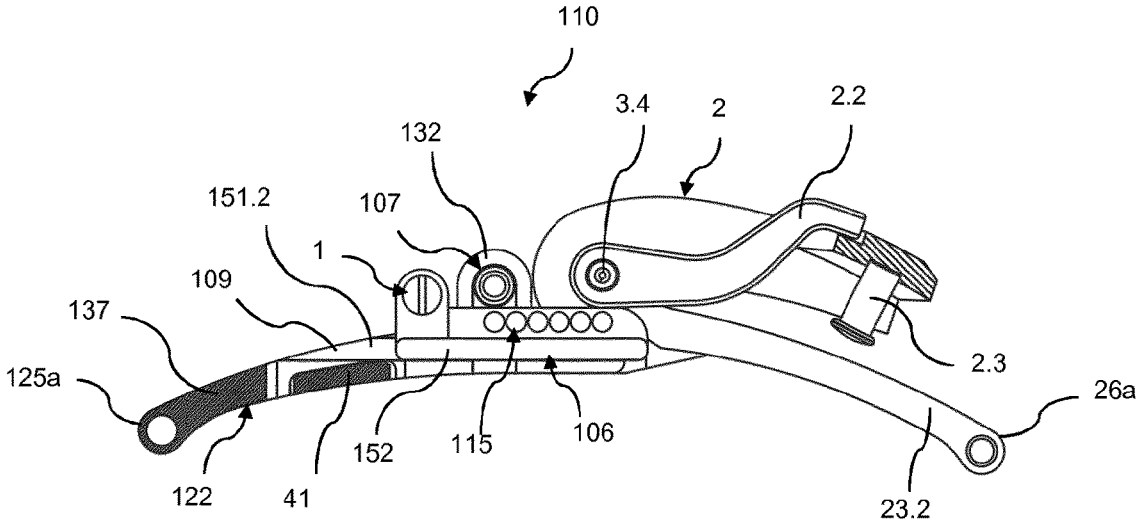
FIG. 13 is a longitudinal section side view of the clasp of FIGS. 10 to 12 shown in closed position.

In one embodiment, the clasp includes first and second attachment members 1, 2. The present invention is not limited to a specific attachment member, and many means are known for attaching the free ends of the two bracelet strands to a clasp. In the embodiment shown in the figures, the first attachment member is provided in the form of a crossbar 1, and the second attachment member is in the form of a tongue buckle 2. As can be seen in FIGS. 4 and 13, a tenon 2.3 is present on the lower face of the crossbar of the frame 2.1 of the tongue buckle. The free end of the bracelet strand can then be secured to the clasp by inserting the tenon 2.3 and/or the tongue 2.2 into holes in the end of one of the two bracelet strands. The tenon 2.3 further illustrates the ornamental function of the tongue buckle 2. Tongue buckles are generally known as whole clasps, while in the case of the clasp shown in the figures, the tongue buckle is combined with an extensible buckle clasp. In the case of the clasp shown in the figures, the clasp is generally opened by the locking means 3 described above and not by detaching the bracelet strand from the tenon 2.3 and/or the tongue 2.2.

In one embodiment, the present invention relates to a length-adjustment device for a clasp that can be made with any type of bracelet clasp. A person skilled in the art will observe, upon reading the description of two preferred embodiments, that the length-adjustment device is independent from the clasp closing or locking means. The length-adjustment device allows the length to be adjusted regardless of the open or closed position of the clasp. Therefore, it is possible to adjust the length of the bracelet without removing the wristwatch provided with the clasp of the invention from the wrist.

The clasp according to the invention comprises a length-adjustment device 5, 105, secured to a support. In the embodiments shown in the figures, the second blade 22; 122 provides the role of support for the adjustment device.

Figure 2:
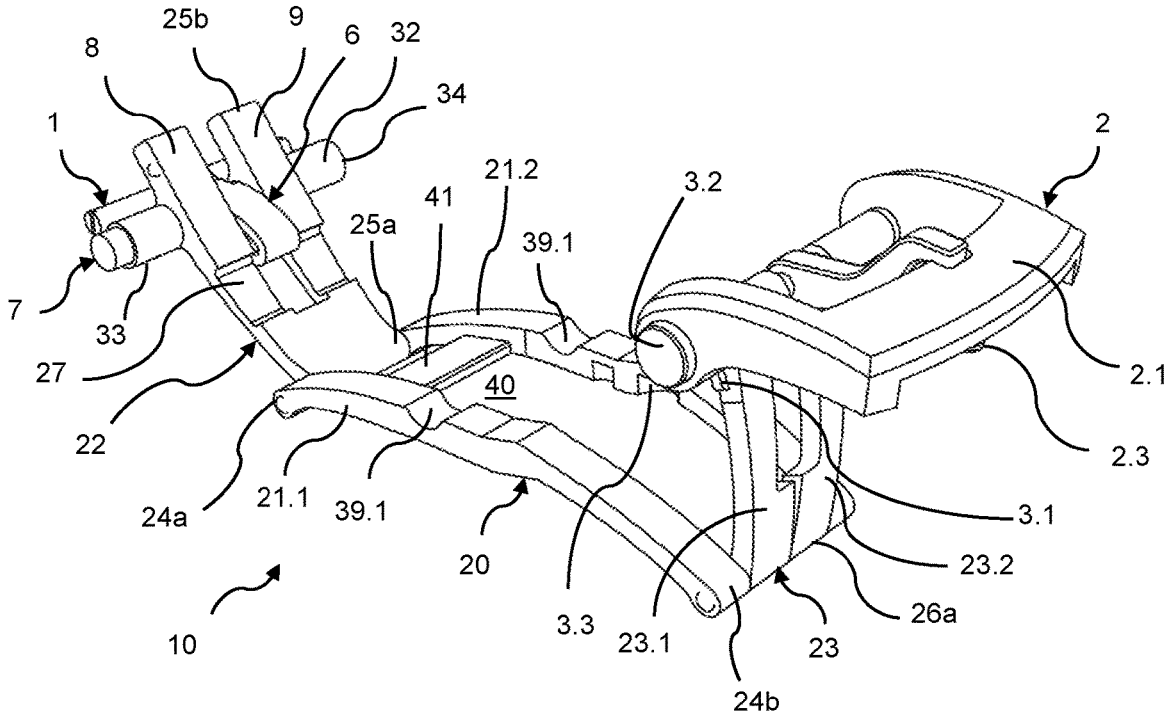
FIG. 2 is a perspective view of the clasp of FIG. 1 shown in open position.
Figure 3:
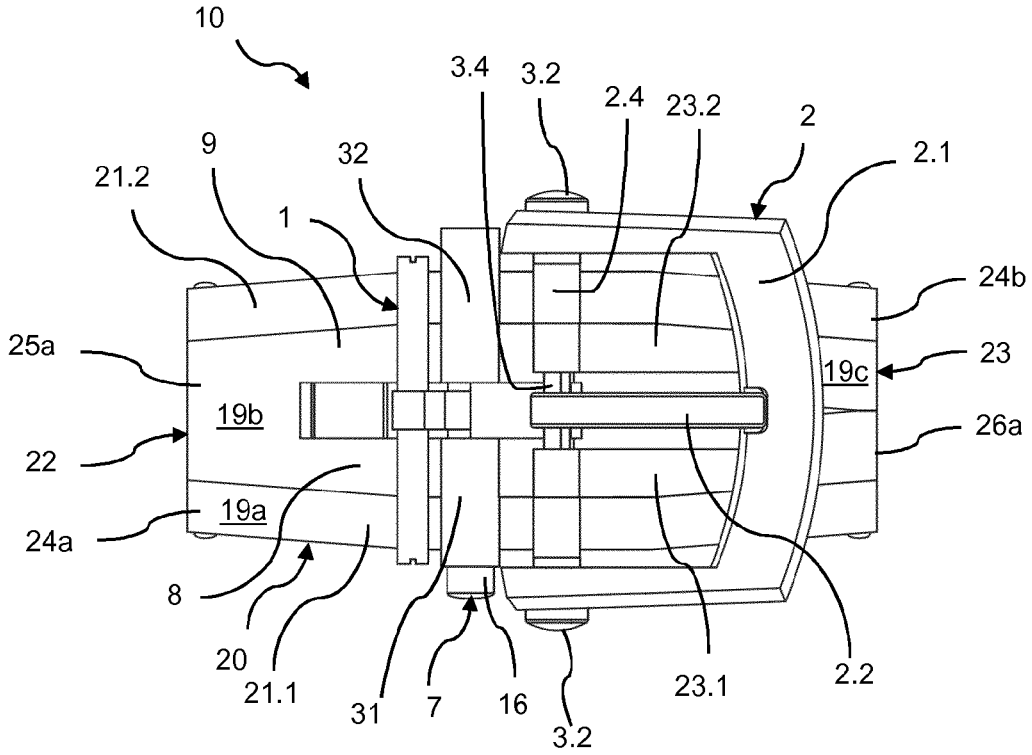
FIG. 3 is a top-down view of the clasp of FIG. 1.
Figure 5:
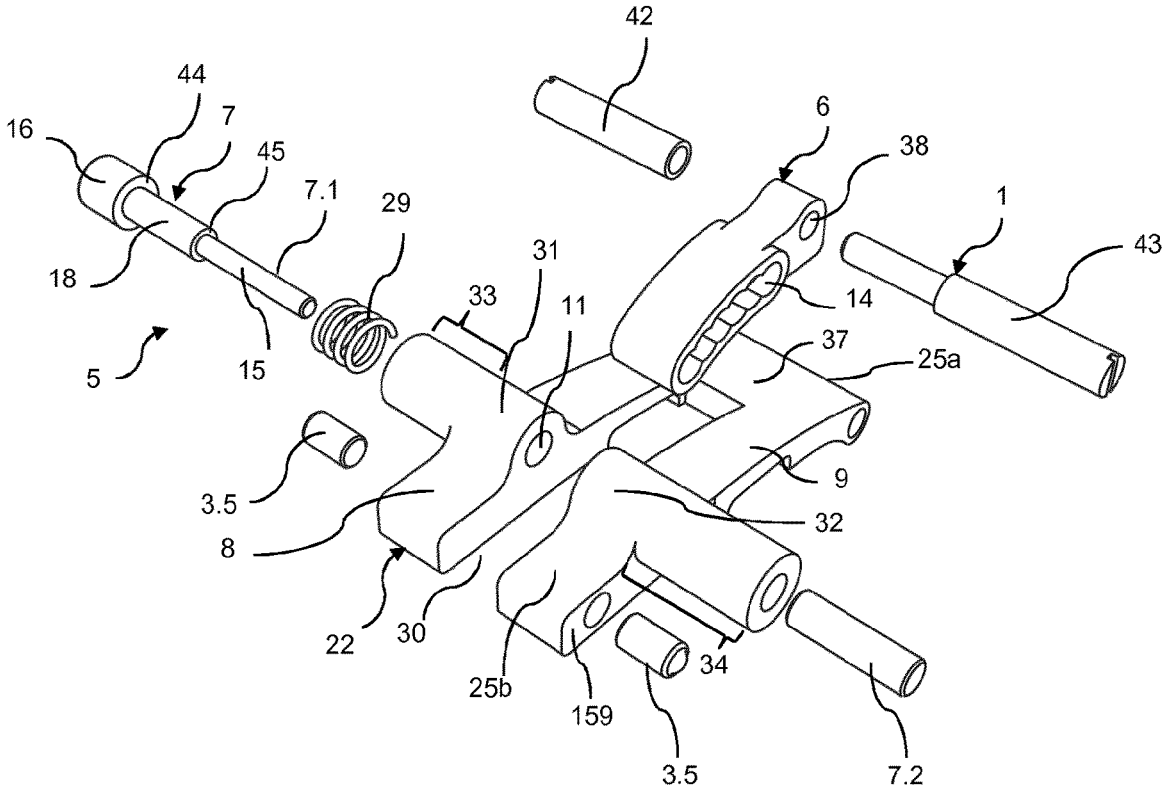
FIG. 5 is a perspective view of the blade including the length-adjustment device of the clasp of FIGS. 1 to 4, the bracelet length-adjustment device being shown in exploded view.
Figure 6:
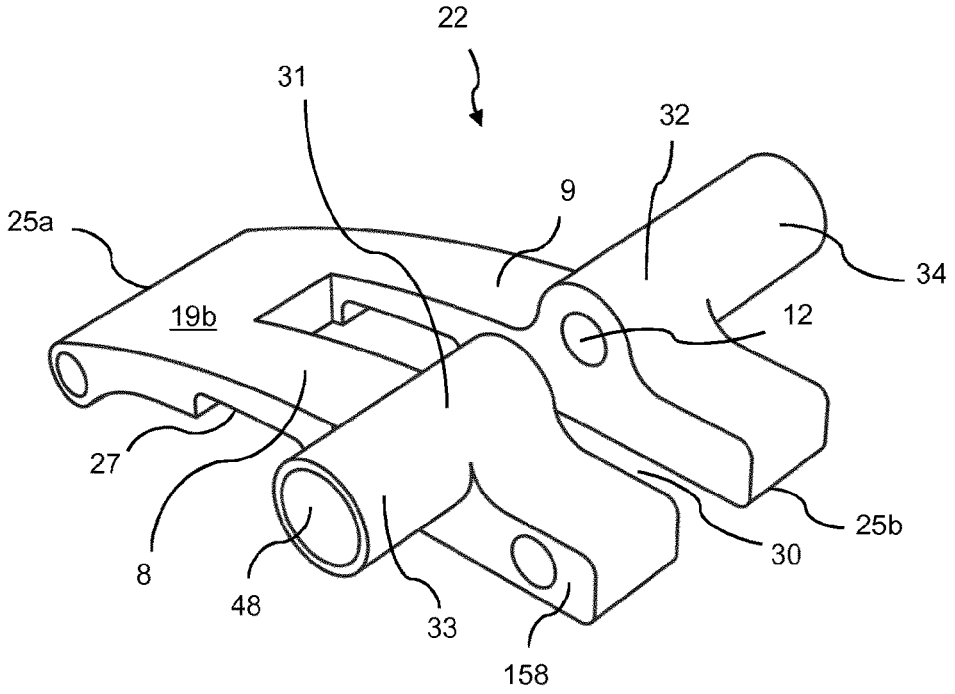
FIG. 6 is a perspective view of the blade including the device for adjusting the length of the clasp of FIGS. 1 to 4.

As will be explained with reference to FIGS. 2 and 5, the second blade 22 comprises, towards the first end thereof 25*a*, a base 37 for two side members 8, 9 which are substantially parallel and follow the longitudinal direction of the clasp. The side members 8, 9 are separated by a space 30, provided for housing the mobile piece 6 and for allowing same to move in the longitudinal direction of the clasp when adjusting the length. The mobile piece 6 is shown enlarged in FIGS. 7A to 7C.

In the embodiment shown, the side members 8, 9 are only connected, rigidly, by the base 37. Therefore, the space 30 which serves as a housing for the mobile piece 6 extends through the entire blade 22 in the radial direction. In other terms, the space 30 is an indentation delimited only (ignoring the locking element 7) laterally by the side members 8, 9 and towards the first end 25*a* of the blade 22 by the base 37. The indentation 30 is open towards the bottom and the top (along the radial direction) and also towards the free end 25*b* of the second blade 22.

Figure 7A:
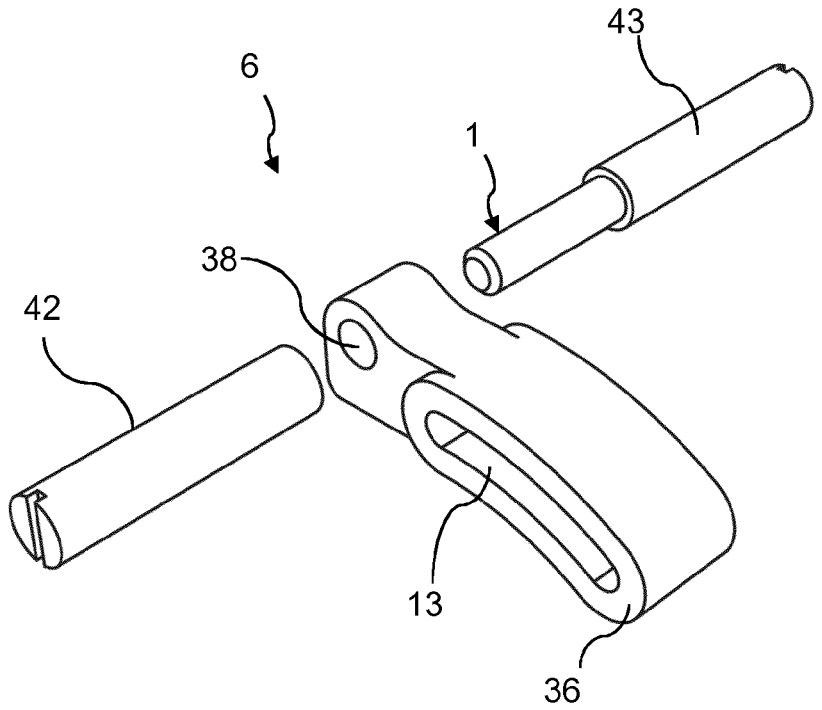
FIGS. 7A to 7E are perspective views (A, B, D, E) and a side elevation view (C) of the mobile piece of the clasp of FIGS. 1 to 4.
Figure 7B:
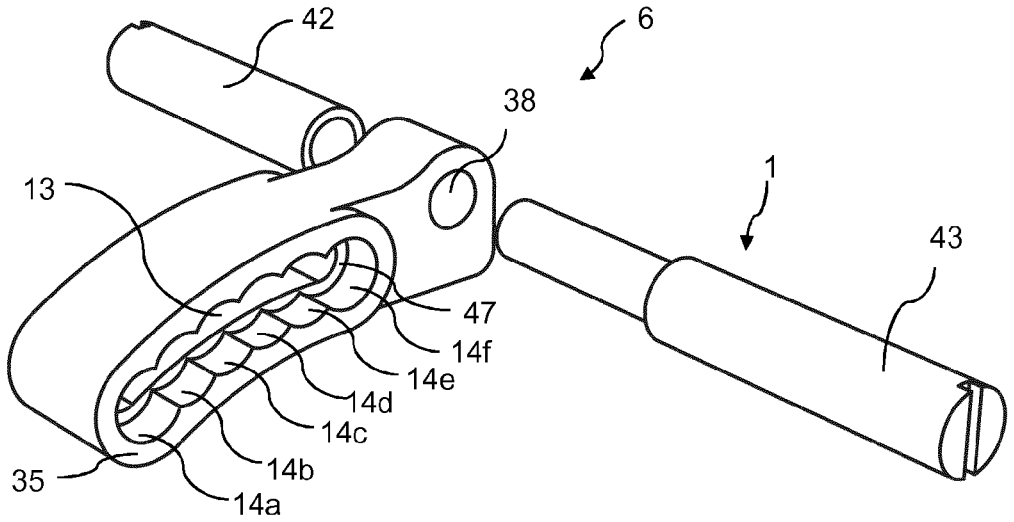
Figure 7C:
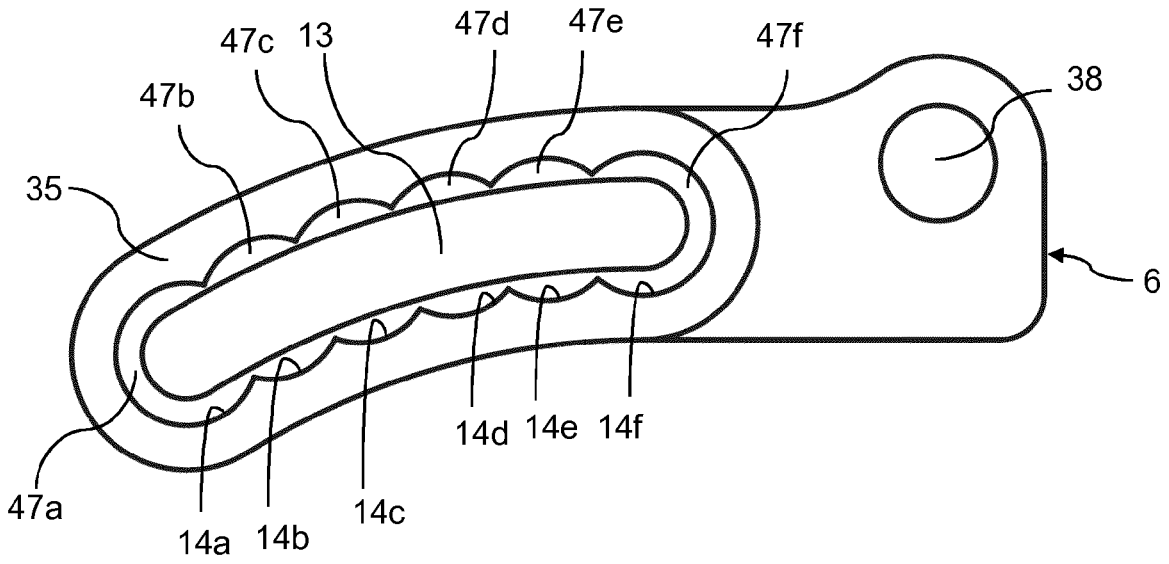

The mobile piece 6 is shown separately in FIGS. 7A-7C. It has a longitudinal shape. Its thickness along an orthogonal direction allows it to be inserted and housed precisely in the space 30 formed between the two side members 8, 9. Towards one of the ends thereof, the mobile piece comprises a cylindrical hole 38 in the orthogonal direction, for housing a pin serving as an attachment member 1 for securing the free end of a first bracelet strand. The pin comprises two parts, the first of which 42 comprises a tapped tubular portion and the second 43 an end provided with a thread (not shown) in order to be able to be connected to the tapped tube. On the side of the threaded end, the part 43 has a reduced diameter, in order to be able to pass precisely through the hole 38 and to rigidly connect the pin 1 to the mobile piece 6 when the first portion 42 is screwed into the tapped portion 42.

As can be seen clearly in FIG. 7A, the mobile piece 6 comprises a longitudinal slot 13.

In one embodiment, the locking element is a locking cylinder and/or pin 7 including a narrower section 15. The size of the narrower section 15 substantially matches the height of the longitudinal slot 13 arranged in the mobile piece 6, so that the locking element can pass through said longitudinal slot.

The locking pin 7 can be designated more generally as locking member or locking element 7, 107.

As is understood, the extension of this slot in the longitudinal direction determines the maximum distance over which the device for fine length adjustment makes it possible, on its own, to adjust the bracelet length. The view of FIG. 7B shows a series of recesses 14*a*, 14*b*, 14*c*, etc., provided on one of the two side faces 35, 36 of the mobile piece, along the longitudinal slot 13. The set of recesses 14*a*-14*f* constitutes a serrated portion 14 which defines the fine adjustment positions. In the embodiment shown, the side face including the recesses 14 is the first face 35, and the other side face is the second side face 36 of the mobile piece. Since the serrated portion 14 is only on one of the two side faces 35, 36, the mobile piece 6 of the shown embodiment is asymmetrical relative to the general plane of symmetry of the clasp.

Unexpectedly, the mobile piece 6 is slightly curved along the longitudinal extension thereof, similarly to the curve of the second blade 22 and preferably following the curve of the central blade 20. Such a curve is unexpected, since it would not be contemplated in the case of a conventional clasp, including a mobile piece sliding on a rail. As described hereinafter, the specific way in which the mobile piece 6 is secured to the support 22 makes it possible to give the mobile part a curved shape.

The mobile piece 6 is secured to the support 22 by the member 7, which is housed in an essentially tubular recess so as to pass through the space 30 along an orthogonal axis. The element 7, by passing through the longitudinal slot 13 of the mobile piece 6, retains the latter and secures it to the second blade 22.

In one embodiment, said support 22 includes two side members 8, 9, separated by a central longitudinal opening 30, and the mobile piece 6 is provided so as to pivot in said central opening 30.

In one embodiment, the locking element and/or pin 7; 107 is provided in a direction orthogonal to the length direction of the bracelet.

In one embodiment, the locking pin is intended for being moved axially in order the unlock the adjustment device 5 and to allow a length adjustment of the bracelet.

In one embodiment, the housing 31, 32 of the locking element 7 is arranged so that a portion of the locking element 7 is located above said first blade 20 when the clasp is in a closed position. The housing 31, 32 of said locking element 7; 107 protrudes from the general upper surface 19*b* of said second blade 22.

The housing of the pin 7 comprises two tubes 31, 32 which are provided in an orthogonal orientation on either side of the space 30, on the two side members 8, 9 of the second blade 22. The two tubes 31 and 32 protrude from the upper surface of the second blade and thus of the common surface between the blades of the clasp in closed clasp position. The tubes 31, 32 thus appear as bulges 31, 32 on the side members 8, 9 of the second blade 22. In the embodiment shown in the figures, the tubes 31 and 32 are formed as a single part with the second blade 22.

In one embodiment, the locking element is a locking pin 7; 107, housed so that the axis thereof is located above the plane formed by the common upper surface 19*a*, 19*b* of said first and second blades 20, 22.

In one embodiment, said second blade 22 includes first and second side members 8, 108; 9, 109, the mobile piece 6; 106 being arranged between said side members, a first portion 31; 131 of the housing of the locking element 7; 107 being arranged in a bulge of said first side member 8, 108, and a second portion 32; 132 of the housing being arranged in a bulge of said second side member 8, 108.

In one embodiment, the housing 31; 131 of said locking element 7; 107 protrudes laterally, in a direction orthogonal to the length direction of the bracelet, from a flank 158 of said second blade 22, in order to be located above said side posts 21.1; 21.2 of said first blade 20 when the clasp is in a closed position.

For example, the housing of the locking member 7; 107 can include a tubular portion 33; 139, arranged in an orthogonal direction on said second blade 22 so as to protrude from a side flank 158 of the second blade 22 and to be provided above the upper surface 19*a* of the first blade when the clasp is in closed position.

The housing of the locking pin 7 comprises tubular portions 33 and 35 (FIG. 8B) which are part of the bulges 31, 32 on the side members 8, 9. The tubular portions 33, 35 are the portions of the housing that protrude laterally from the flanks 158, 159 of the second blade 22. This is notable insofar as, as is described above, the second blade 22 is arranged to be inserted between the two posts 21.1 and 21.2 of the first blade 20 when the clasp is in closed position.

These lateral extensions 33 and/or 35 of the housing do not impede this insertion due to the whole housing 31, 32, and thus also the tubes 33 and 35, being above grade relative to the general surface 19*a*, 19*b*, 19*c* of the clasp. As described in the present description, the first blade 20 can also comprise one or more cavities 39.1, 39.2, for allowing the lowering of the second blade 22.

In one embodiment, one end 16; 116 of the locking element 7; 107 emerges through a lateral opening of the housing 31, 32; 131, 132, said end being arranged to form an actuating member 16; 116 of the length-adjustment device 5; 105.

According to one embodiment of the invention, the mobile piece 6 is pivotably mounted on a first support, i.e. the second blade 22. Preferably, the axis of the pin 7 corresponds to and/or constitutes the axis of rotation of the mobile piece 6. According to this embodiment, the pin 7 is preferably the only structural element that connects the mobile piece 6 to the support. Finally, the pin 7 preferably also operates as a locking structure for blocking the mobile piece in a position defining an adjusted fine length along the longitudinal direction of the bracelet.

In order to understand the operation of the fine length-adjustment device according to this embodiment, the configuration of the locking pin 7, its housing and the serrated portion 14 of the mobile part will be described in reference to FIGS. 5 to 9B.

Figure 8A:
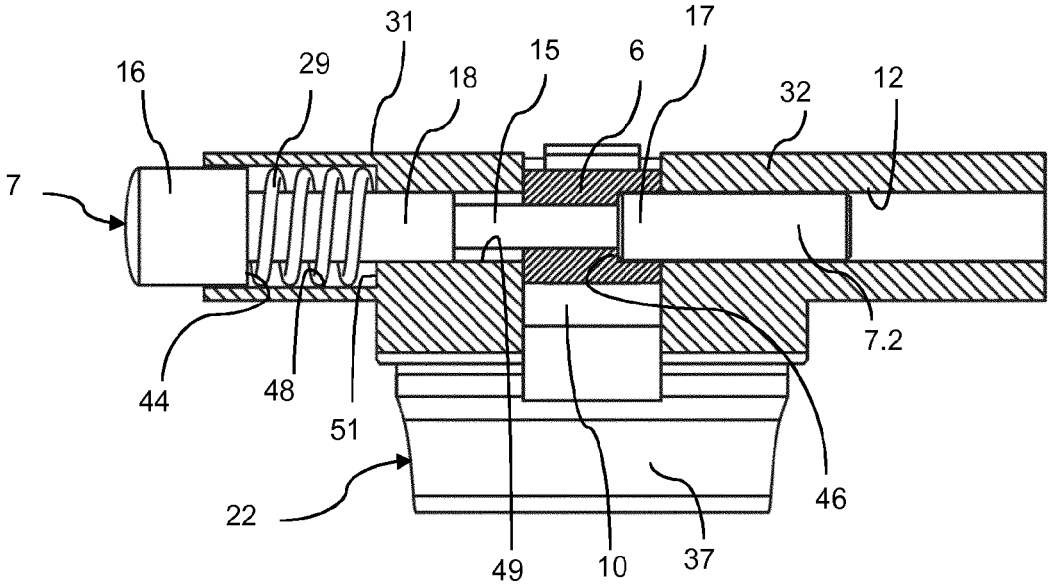
FIGS. 8A and 8B are cross-section views showing the length-adjustment device of the clasp of FIGS. 1 to 4 in inoperative position and in operative position, respectively.
Figure 8B:
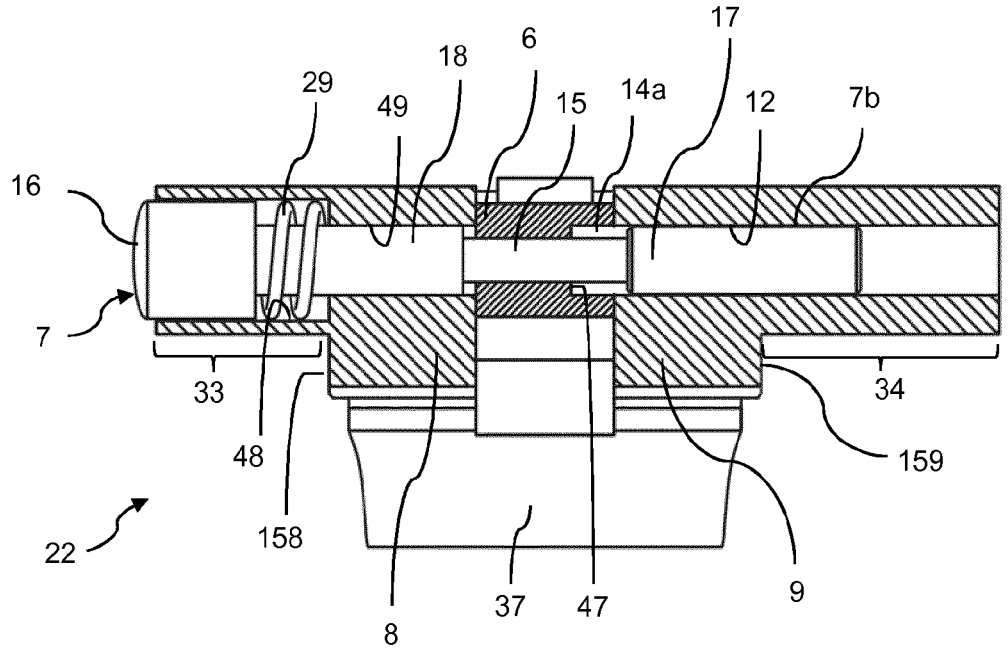

In the embodiment shown, the locking pin 7 is made up of two separate parts 7.1, 7.2. The first part 7.1 comprises a series of coaxial cylinders having different diameters. The cylinder 16 towards one of the ends of the part 7.1 constitutes an actuating member in the form of a push member 16. In the embodiment shown, the push member 16 comprises a cylindrical portion provided at one of the ends of the pin 7 and forming a first section of the latter. The cylinder 18 following the push member 16 comprises a slightly reduced diameter compared with the diameter of the push member 16. Said section 18 can be considered a guiding cylinder 18. The reduced diameter of the guiding cylinder 18 gives rise to the first annular flange 44, formed between the push member 16 and the guiding cylinder 18. Said first annular flange 44 serves as a bearing surface for the spring 29, as shown in FIGS. 8A and 8B. The diameter of the cylindrical section 15 towards the end opposite the push member 16 of the first part 7.1 is further reduced relative to the diameter of the guiding cylinder 18. The diameter of the section 15 is substantially identical but slightly smaller than the axial extension (height) of the slot 13 made in the mobile piece 6. This allows for precise insertion of the mobile piece 6 onto the pin 7 and, in particular, onto the through-section 15 of the pin 7 (FIGS. 8A and 8B). In one embodiment, said mobile piece 6 includes a longitudinal slot 13 with said locking element/pin 7 passing therethrough. At the free end thereof, the through-section 15 comprises an outer thread, complementing the inner thread tapped in the second part 7.2 of the pin 7. The part 7.2 thus operates as a nut for securing the pin in the housing formed by the tubes 31 and 32 arranged on the blade 22.

Figure 7D:
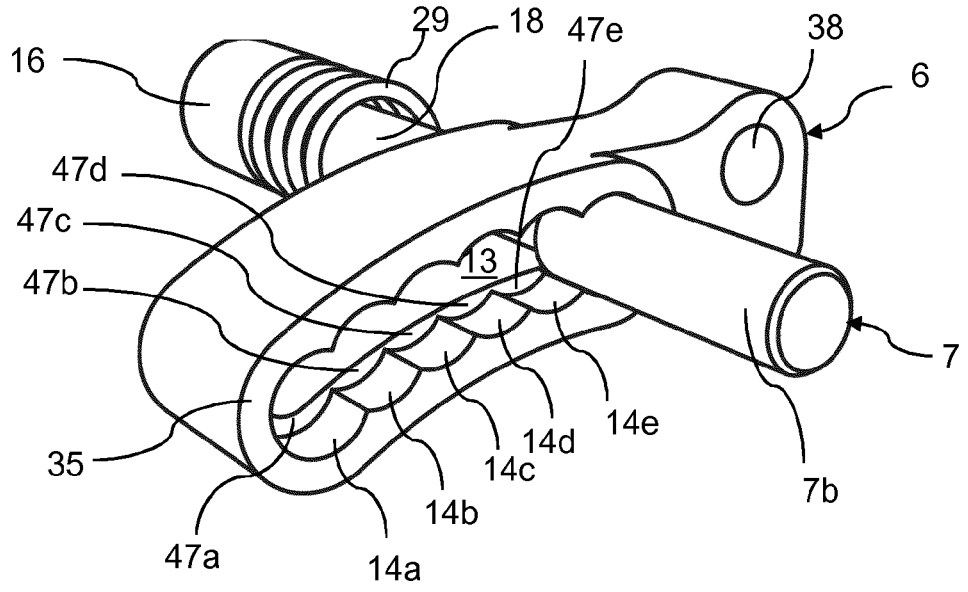

As can be seen clearly in FIGS. 7C and 7D, the serrated portion 14 arranged on the first side face 35 of the mobile piece comprises a series of recesses 14*a*-14*f*.

In the present description, the reference number 14 indicates the serration formed by a series of recesses 14*a*-14*f* or else the set of recesses 14*a*-14*f*. The number 14 can also be used to refer to any given gap among the recesses 14*a*-14*f*.

In one embodiment, the locking pin 7 includes a bulge, a flange or a locking structure 17 with a shape that complements the shape of one of the recesses of the serrated portion 14 arranged in the mobile piece 6 along said longitudinal slot 13.

The shape of these recesses is chosen so as to allow them to receive a locking structure or a bulge 17 arranged on the locking pin 7. In the embodiment shown, the locking structure 17 is actually the part 7.2, the diameter of which is larger than the diameter of the through-section 15, so that a third annular flange 46 is created between the through-section 15 and the cylindrical section formed by the second part 7.2, hereinafter also referred to as nut part 7.2.

A person skilled in the art will understand that it is also possible, in an alternative embodiment, to produce the pin 7 by a first part including the sections 16 and 18 and a second part including the sections 15 and 17. In this case, the section 18 may comprise the tapping and the free end of the section 15 passing through the thread in order to screw the two parts together and thus to secure the mobile piece.

In the embodiment shown, each of the recesses 14*a*, 14*b*, 14*c*, etc. of the mobile piece 6 can be considered to be formed by two semi-recesses, one of which is arranged above the other below the longitudinal opening formed by the slot 13.

In one embodiment, said mobile piece 6 includes a serrated portion 14 formed by a series of recesses 14*a*-14*f* partially crossing the mobile piece, so as to create, inside the mobile piece 6 one or more bearing surfaces 47 against which a locking structure 17 abuts when the length-adjustment device 5 is in blocked position.

As regards the particular shape of the serrated portion 14, it is useful to understand that each gap 14*a*, 14*b*, 14*c*, etc. is indeed made up of a cylindrical bore (partial, blind and/or non-through) in orthogonal direction, in the first side face 35 of the mobile part 6. The bores that produce the recesses 14 have a diameter larger than the size of the slot 13 in the radial direction (height). In addition, the bores are blind, since the depth of the bores is smaller than the size of the mobile part 6 in orthogonal direction, i.e. smaller than the width of the part 6. Thus, the bores made to create the recesses 14 form a flange 47 or a plurality of flanges inside the mobile piece 6, in particular along the slot 13 of the mobile piece. In the embodiment shown, these flanges operate as bearing surfaces for the locking pin 7, as will be described hereinafter. Due to the diameter of the bore of the recesses 14 relative to the height of the slot, each of the inner recesses 14*b*-14*e* includes a pair of flanges, i.e. an upper flange and a lower flange. The two recesses located at the two opposite ends of the slot 13 (the recesses 14*a* and 14*f* shown in FIG. 7D) include the continuous flange 47*a* and 47*f*, respectively. This continuous flange echoes the contour of a sickle (FIG. 7C).

As can be seen in FIG. 7C, each of these pairs of flanges (or bearing surfaces) 47 is substantially in the shape of a circle segment. This specific shape is due to the fact that, in the shown embodiment, the bores made to create the recesses 14 are brought closer together along the longitudinal direction, so that the circles that define the diameter of a bore overlap. This overlapping also makes it possible to reduce the discrete distances for fine adjustment and thus to have even finer adjustment.

The shape of the flanges 47 depends partially on the diameter of the bore of the recesses 14 relative to the height of the slot 13, and partially on the shape of the longitudinal slot 13. In an alternative embodiment, the mobile piece 6 comprises a continuous flange 47 extending along the slot 13. A continuous flange 47 may be obtained by choosing a larger diameter for the bore of the recesses, or a smaller height of the slot 13.

The one or more bearing surfaces 47 are preferably in a plane that is parallel to the plane of symmetry of the clasp and/or in a plane that is parallel to the side surfaces 35, 36 of the mobile piece, as can be seen clearly in FIGS. 7 and 8B. The one or more bearing surfaces 47 will serve as bearing surfaces for the locking structure 17 of the locking pin 7.

The flanges 44-46 of the pin 7 are also all parallel to the plane of symmetry of the clasp (vertical in FIGS. 8A and 8B).

The operation of the length-adjustment device 5 and of the locking device will be described hereunder in reference to FIGS. 7D to 9B. The housing of the pin 7 comprises two tubes 31, 32, provided on either side of the space 30 arranged between the side members 8 and 9. The tube 32 of the side member 9 (hereinafter, the second tube) only contains one hollow cylinder with constant diameter. Conversely, the tube 31 of the side member 8 (hereinafter, the first tube) contains, towards its outer side end, a hollow cylinder with widened diameter, forming a housing 48 for the push member 16 (FIG. 8). The second portion 49 of the hollow cylinder of the tube 31 is characterized by having a smaller diameter than the diameter of the housing 48. This reduced diameter allows the passage of the guide section 18.

The spring 29 rests on the flange 51, formed between the hollow and coaxial cylinders with different diameters 48 and 49 of the first tube 31, as well as on the first annular flange 44 of the pin 7, defining the push member 16 of the guide section or cylinder 18 of the pin 7. Thus, the spring 29 biases the pin 7 towards the end of the push member 16. The latter emerges from the tube 31 to constitute an actuating member 16 that can be activated by a wearer since it is accessible from outside the clasp.

In one embodiment, the actuating member 16, 116 is biased by a spring 29 in locked position. The spring 29 is preferably housed in the housing of the locking pin 7; 107.

Figure 9A:
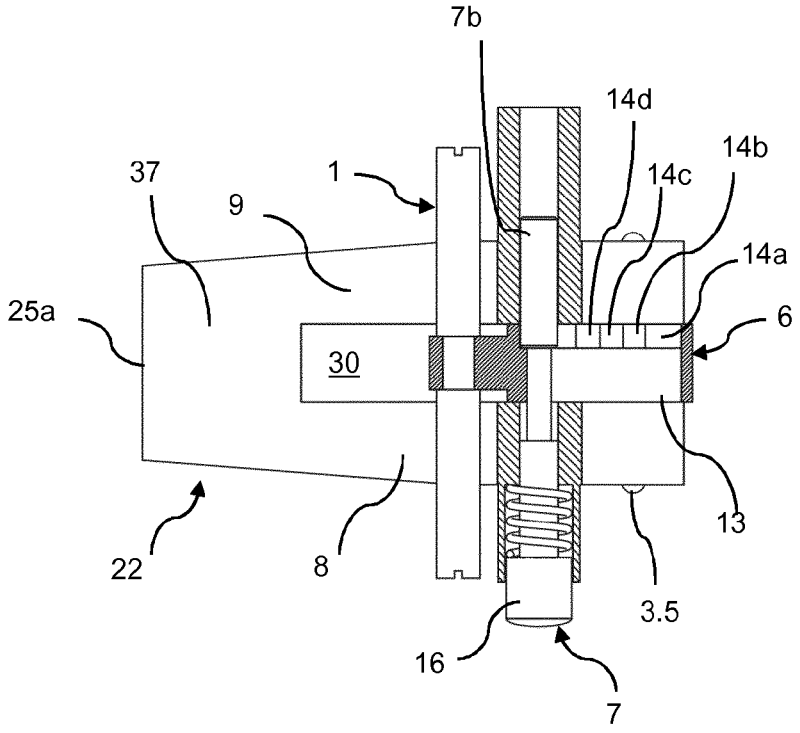
FIGS. 9A and 9B are longitudinal section top-down views showing the length-adjustment device of the clasp of FIGS. 1 to 4 in inoperative position and in operative position, respectively.

As can be seen in FIGS. 8A and 9A, the pin 7 is kept in the housing thereof by the nut portion 7.2, the flange 46 of which abuts with the flange 47 inside the recesses 14 of the mobile piece 6. In this position, the mobile piece is blocked or locked, since the nut part 7.2 is inside one of the recesses 14*a*-14*f*, and prevents a movement of the mobile piece along the longitudinal direction of the bracelet.

However, the recesses 14 do not prevent the mobile piece 6 from rotating about the axis of the pin 7. As mentioned above, the part 7.2, one end of which 17 operates as locking element, is cylindrical, and the recesses 14 are adjacent cylindrical bores. The section 15 of the pin 7 passing through the slot 13 is also cylindrical and also does not prevent the pivoting of the mobile piece 6. On the other hand, the mobile piece 6 cannot perform a complete rotation, since the attachment member 1 prevents a free rotation of the mobile piece inside the space 30. When the clasp is closed, the spacer 41 can also limit the radial angle of rotation of the mobile piece 6.

Figure 7E:
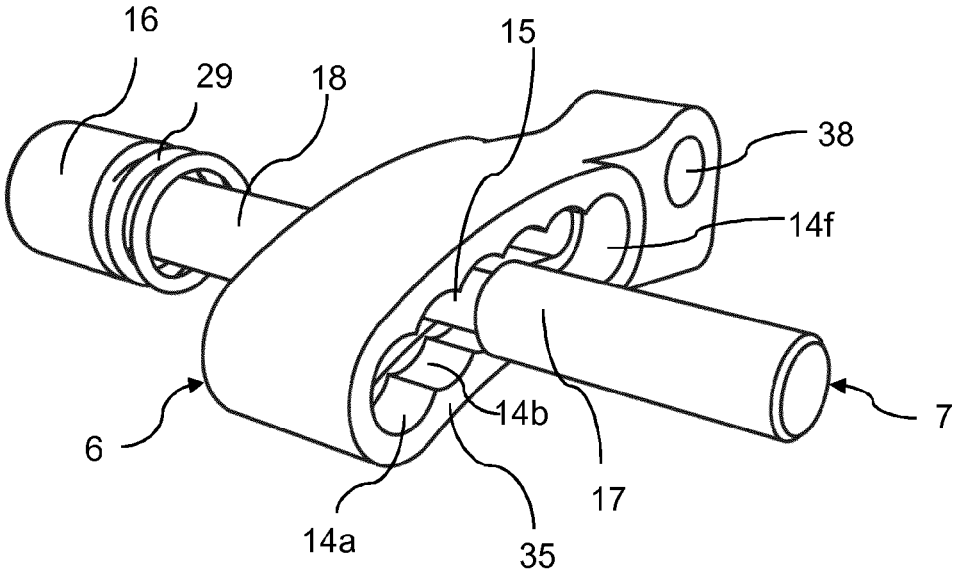
Figure 9B:
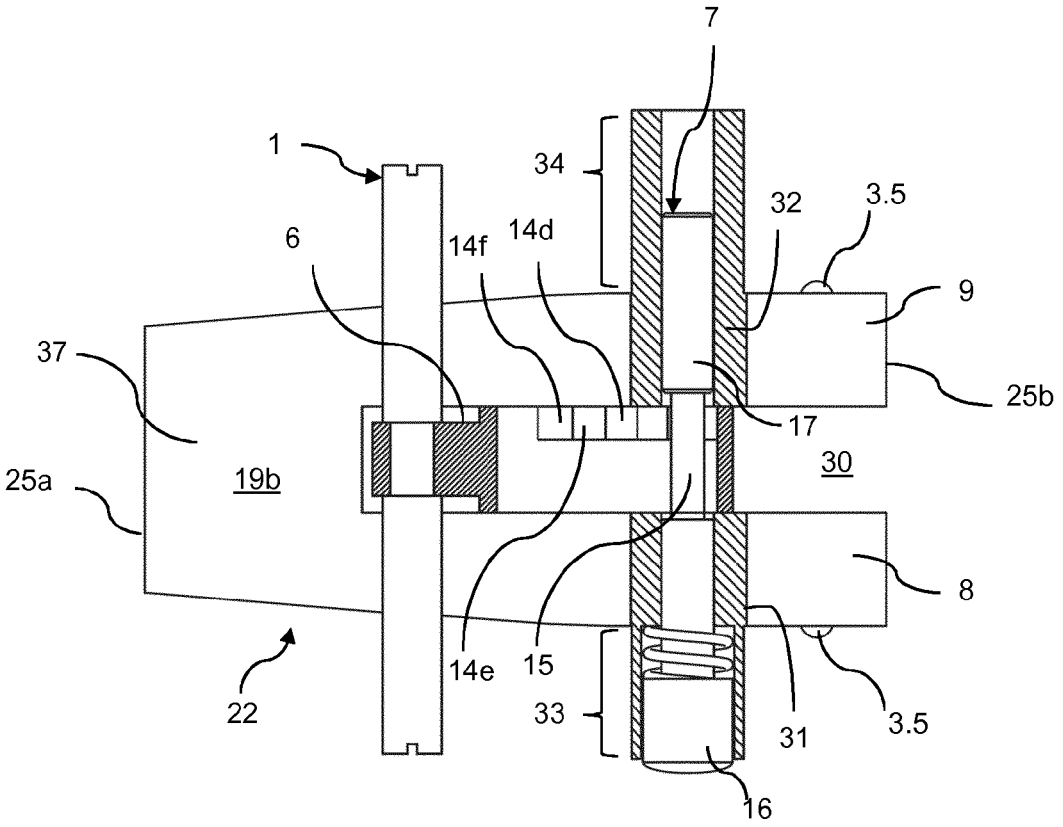
Figure 10:
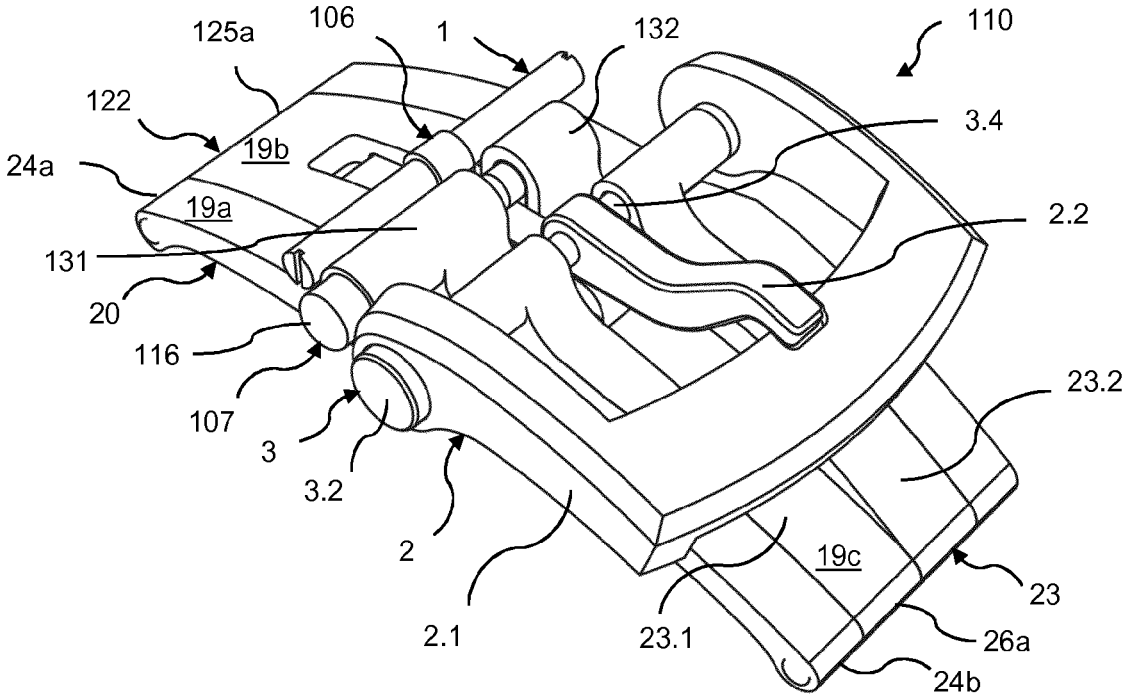
FIG. 10 is a perspective view of a bracelet clasp according to a second embodiment of the present invention. The clasp is shown in closed position.
Figure 11:
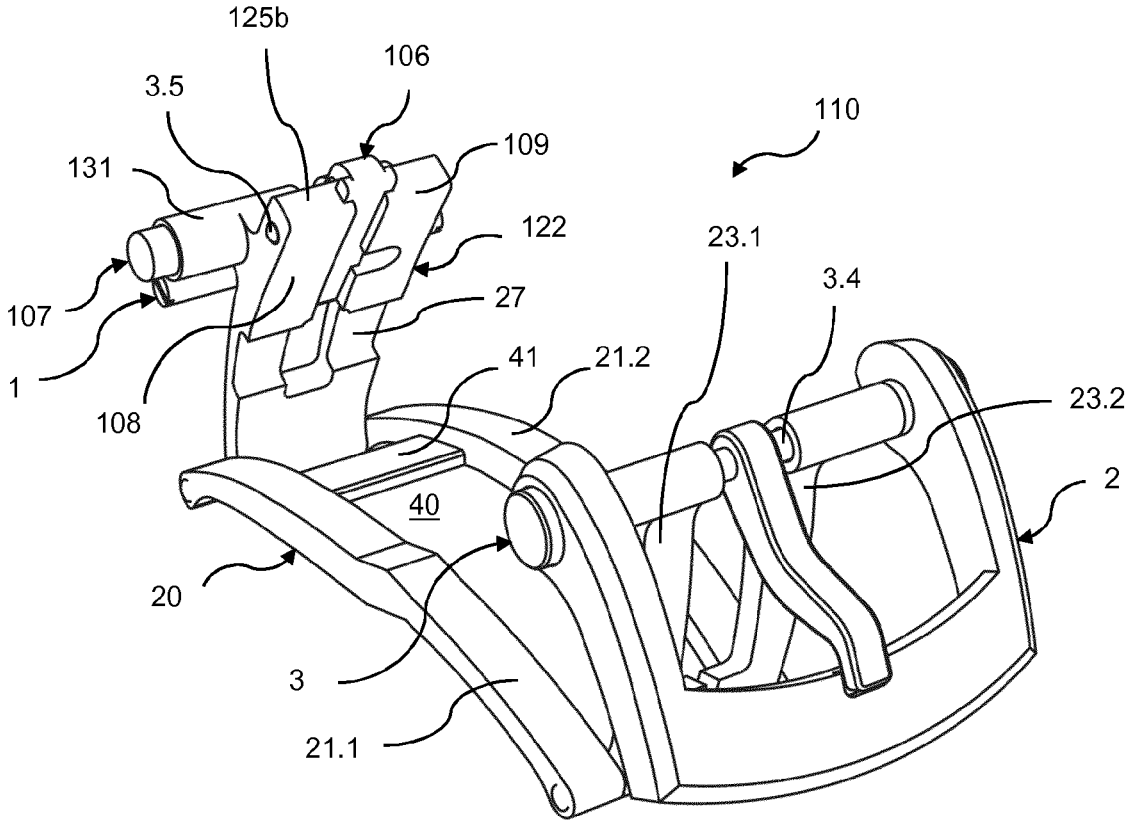
FIG. 11 is a perspective view of the clasp of FIG. 10 shown in open position.
Figure 12:
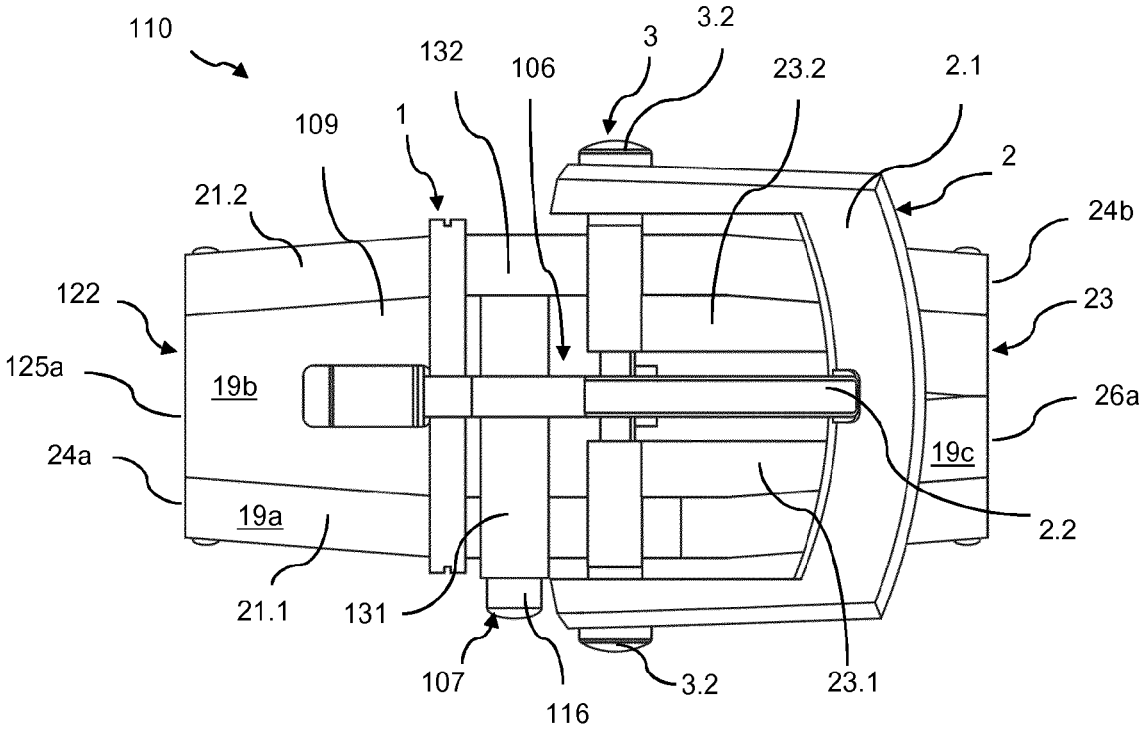
FIG. 12 is a top-down view of the clasp of FIG. 10.

The inoperative position or the locked position, shown in FIGS. 7D, 8A and 9A, is differentiated from the operative position or unlocked position, shown in FIGS. 7E, 8B and 9B. In order to finely adjust the length of the bracelet by means of the clasp of the invention, it is convenient first of all to pass from the locked position to the unlocked position. Indeed, in locked position, the mobile piece is prevented from moving in a longitudinal direction of the bracelet. It should further be noted that the locked position is preferably a stable position, since it is maintained by means of the spring 29. According to this embodiment, in order to unlock the length-adjustment device, the wearer is required to apply a pushing force on the push member 16. Preferably, it is necessary to keep the push member in pushed position, in order to prevent the locking device from returning to the locked position before the length adjustment.

In order to adjust the length, the wearer presses the push member 16 against the force of the spring 29 and the locking pin 7 thus performs an axial movement defined by the recess and/or the hollow cylinders 48, 49, 12 inside tubes 31 and 32 which form the housing of the pin 7. The axial movement of the pin 7 separates the end 17 of the cylinder 7.2 from the gap 14 in which it is housed. In this way, the mobile piece 6 can move in the longitudinal direction of the bracelet, by moving in the space 30 arranged between the side members 8 and 9. The through-section 15 remains inside the slot 13 while the mobile piece 6 moves. The position of the locking pin 7 along the longitudinal direction is always the same; it is retained by the tubes 31, 32 which only allow the axial movement thereof.

When the wearer releases the pressure on the push member 16, the spring 29 pushes the pin 7 and thus the end of the cylinder 17 into a locked position. Once the pin 7 is aligned with (coaxial with) any given gap of the serration 14, the cylindrical portion 17 is automatically inserted into said gap to block the movement of the mobile piece 6 in a longitudinal direction. This insertion is automatic since the spring 29 biases the pin 7, and in particular the end of the cylinder 17, in the orthogonal direction towards the bearing surface formed by the one or more flanges 47.

A clasp 110 according to a second embodiment is shown in FIGS. 10-18B. This clasp 110 differs from the first embodiment 10 essentially in the length-adjustment device and the corresponding configuration of the blade (or the support) supporting said adjustment device. The closing means for opening and closing the clasp, as well as the first and second attachment members, are identical to those of the clasp according to the first embodiment. The clasp shown in FIGS. 10-18B is also a clasp with three blades and the design thereof is substantially identical to the design of the clasp shown in FIGS. 1-9B.

As in the case of the clasp according to the first embodiment, the clasp according to the second embodiment can be produced in the form of an extensible buckle clasp with two blades or of a tongue buckle clasp only. A person skilled in the art would be able to adapt the invention to any specific type of clasp and, if need be, would be able to implement the clasp shown in FIGS. 14-18 by using another type of attachment members.

The second blade 122 of the second embodiment shown in FIGS. 14-18 is different from the second blade 22 of the first embodiment, while the first and third blades 20, 23 are substantially identical in both embodiments. We may note the absence of the gaps 39.1 and 39.2 in the side posts of the first blade 20 of the first embodiment. Since the locking pin 107 of the second embodiment is housed in a higher position than the locking pin 7 of the first embodiment, the lateral extension 139 (FIG. 15) of the recess of the locking pin does not prevent the complete insertion of the second blade 122 into the space 40 arranged between the side posts 21.1 and 21.2.

The second blade 122 serves as a support for the length-adjustment device 105. The second blade 122, shown separately in FIG. 15, comprises, towards the first end thereof 125*a*, a base 137 for two side members 108, 109 which are substantially parallel and follow the longitudinal direction of the clasp. The side members 108, 109 are separated by a space 130, provided for housing the mobile piece 106 and for allowing same to move in the longitudinal direction of the clasp when adjusting the length. The mobile piece 106 is shown enlarged in FIGS. 16A to 16C.

In the embodiment shown, the side members 108, 109 are only connected, rigidly, by the base 137. Therefore, the space 130 which serves as a recess for the mobile piece 106 extends through the entire blade 122 in radial direction. In other words, the space 130 is an indentation defined only (ignoring the locking pin 107) laterally by the side members 108, 109 and, towards the first end of the blade 122, by the base 137. The indentation 130 is open towards the bottom and the top (along the radial direction) and also towards the free end 125*b* of the second blade 122.

The second blade 122 includes a recess for housing the mobile piece 106 so as to allow the latter to move in the longitudinal direction of the bracelet during the length adjustment and/or when the mobile piece is unlocked. Specifically, a guiding rail is formed by two channels 151.1, 151.2 made in the inner side walls of the side members 108, 109. The mobile piece 106 includes two side flanges 152, 152' to allow the mobile part 106 to slide in the rail 151.1, 151.2. Towards the second end or free end 125*b* of the second blade 122, the rail is open so that the mobile part 106 can be inserted into the recess thereof during the assembly of the clasp 110.

The mobile part 106 is longitudinal and comprises a seat forming two side flanges 152, 152' and a superstructure or vertical wall 153 which rises relative to the seat along the longitudinal span of the mobile piece. Towards the first end thereof, the superstructure 153 comprises a lug 154 provided with a through-hole 155 for housing the pin operating as attachment member 1 as described above in relation with the first embodiment.

In one embodiment, said mobile piece 106 includes a first serrated portion 114 including a series of recesses 114*a*-114*f*, provided along said mobile piece 106 and intended for engaging with a locking stem 117, and in that said mobile piece 106 includes a second serrated portion 115 including a series of recesses 115*a*-115*f*, intended for engaging with a ratchet 135 arranged so as to position the mobile piece 106 in a predetermined and/or indexed position when the adjustment device 105 is unlocked.

In one embodiment, said mobile piece 106 includes a seat 152, 152', housed so as to slide in said second blade 22 and a structure 153 above grade relative to said seat, said first and second serrated portions 114, 115 being formed in the two opposing faces of the superstructure 153.

Figure 16A:
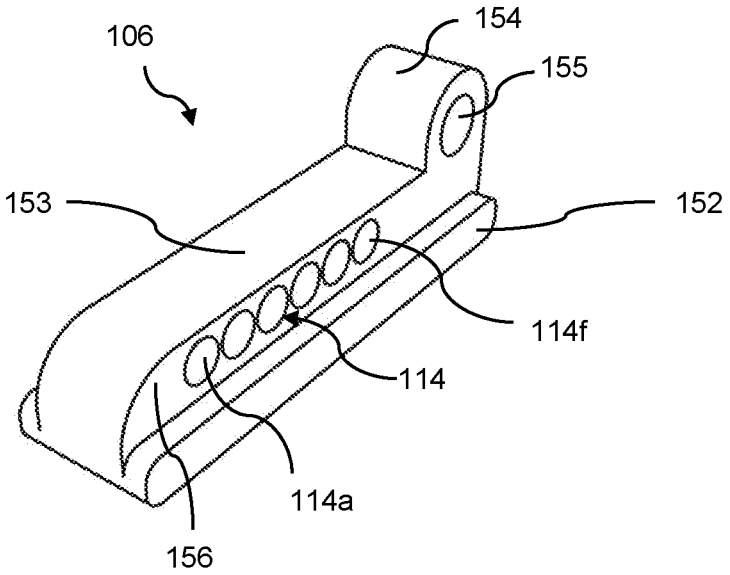
FIGS. 16A and 16B are perspective views of the mobile piece of the clasp of FIGS. 10 to 13.
Figure 16B:
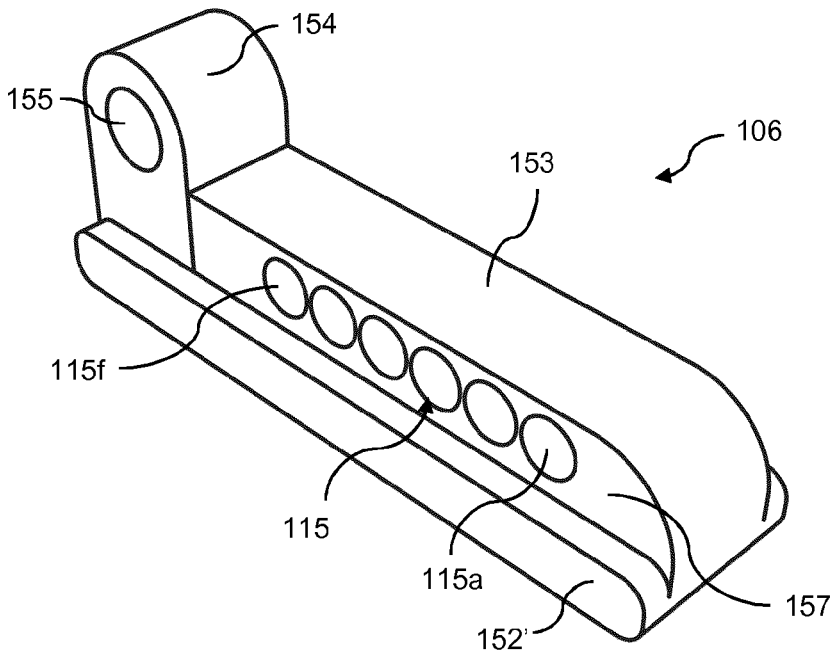
Figure 16C:
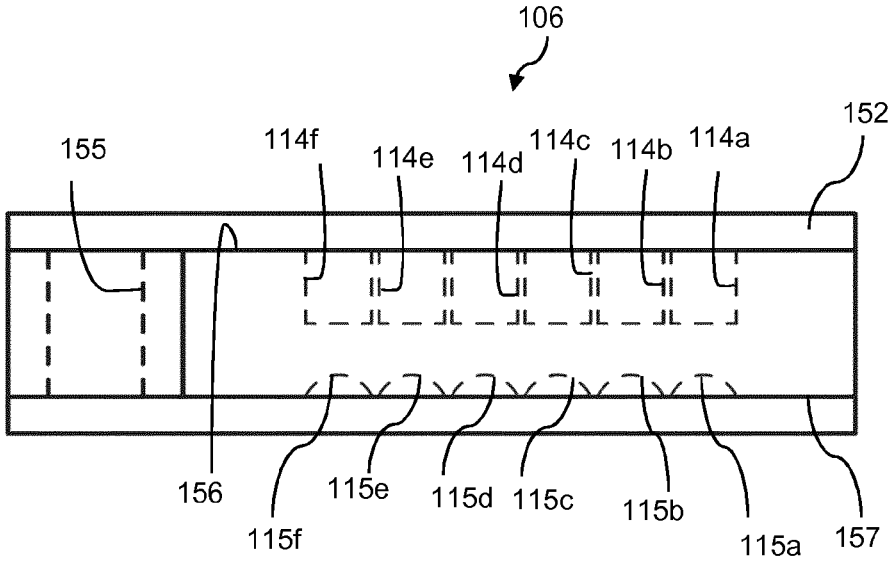
FIG. 16C is a top-down view of the mobile piece of the clasp shown in FIGS. 10 to 13. The positions of the recesses and holes arranged in said part are indicated by dotted lines.

As can be seen clearly in FIGS. 16A to 16C, the longitudinal structure 153 of the mobile piece 106 comprises first and second side faces 156, 157. Each of the side faces comprises a series of recesses 114*a*-114*f*, 115*a*-115*f* to define first and second serrations 114, 115.

In the present description, the reference numbers 114 and 115 indicate the serration formed by a series of recesses 114*a*-114*f* and 115*a*-115*f*, or else the set of recesses 114*a*-114*f* and 115*a*-115*f*, respectively. The numbers 114 and 115 can also be used to refer to any given gap among the recesses 114*a*-114*f* and 115*a*-115*f*, respectively.

In the embodiment shown, a gap of the first serration 114 is coaxial with a gap of the second serration 115. In other words, the recesses on either side of the superstructure 153 are aligned. This alignment of the recesses can be advantageous in the construction of the clasp, but it is not compulsory. The invention can likewise comprise two separate serrations of which the recesses are not coaxial. In the embodiment shown, the recesses of the serrations do not entirely pierce the wall 153. In one alternative embodiment, the wall 153 comprises a serration comprising a series of complete bores, passing through the entire wall 153. In this case, it is not necessary to provide two separate series of recesses, since a single series of recesses could be used as two serrations on either side of the superstructure 153.

Figure 18A:
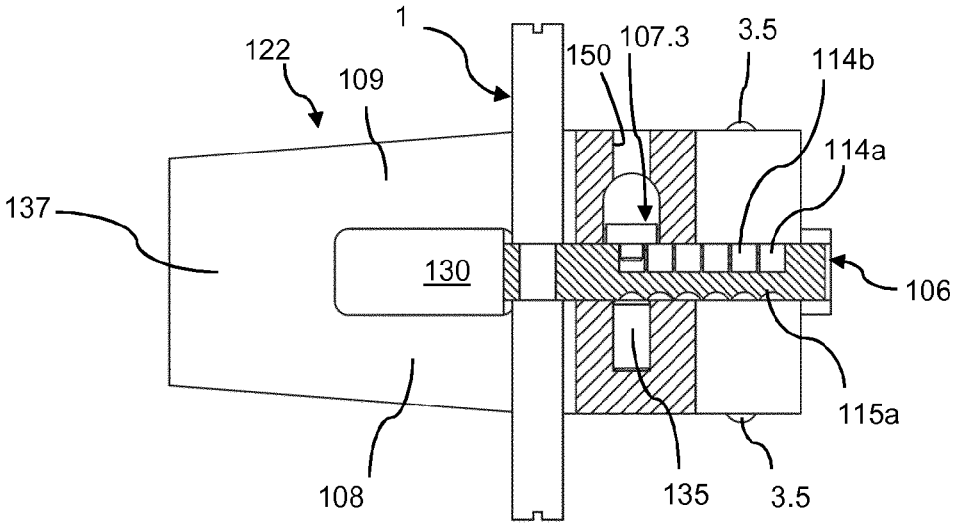
FIGS. 18A and 18B are longitudinal section top-down views showing the length-adjustment device of the clasp of FIGS. 10 to 13 in inoperative position and in operative position, respectively.
Figure 18B:
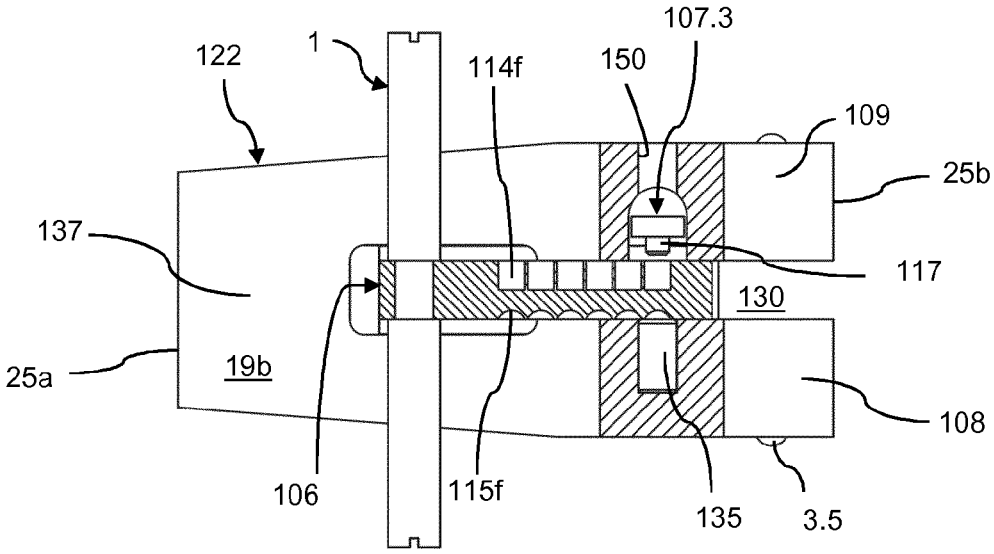

As can be seen best in FIGS. 16C, and 18A-B, the recesses 114 do not have the same shape as the recesses 115. Each of the recesses of the first serration 114 is in the shape of a cylindrical gap, while each of the recesses of the second serration 115 is in the shape of a segment of a sphere and/or of a half-moon gap. It should be noted that the shapes of the recesses 114, 115 as shown in the figures can be advantageous, but the invention is not limited to specific shapes of recesses.

The shape, the configuration and the housing of the locking pin 107 is shown in FIGS. 14, 15, 17A, 17B, 18A and 18B. The locking pin 107 is formed by two longitudinal parts 107.1 and 107.2 (FIG. 14), one of which includes a thread and the other a tapping, making it possible to connect the two parts by screwing during the assembly of the clasp. The first part 107.1 includes two coaxial cylindrical sections or portions 116, 118. The cylinder 116 towards one of the ends of the part 107.1 constitutes an actuating member in the form of a push member 116. In the embodiment shown, the push member 116 comprises a cylindrical portion provided at one of the ends of the pin 107 and forming a first section of the latter.

Figure 17A:
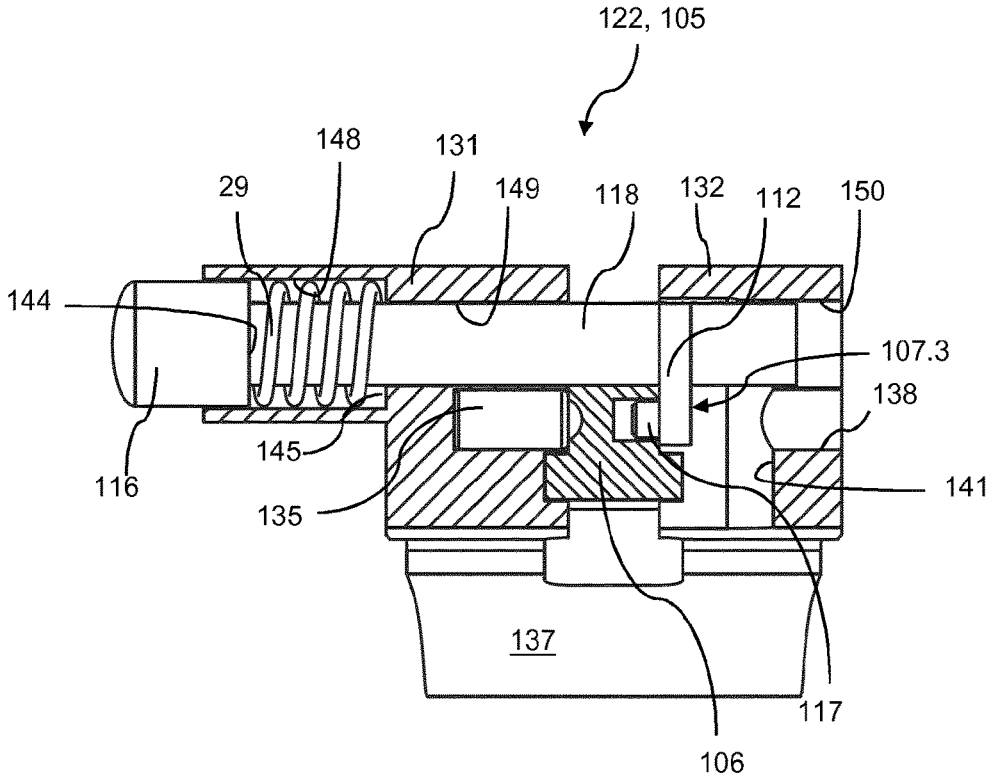
FIGS. 17A and 17B are cross-section views showing the length-adjustment device of the clasp of FIGS. 10 to 13 in inoperative position and in operative position, respectively.
Figure 17B:
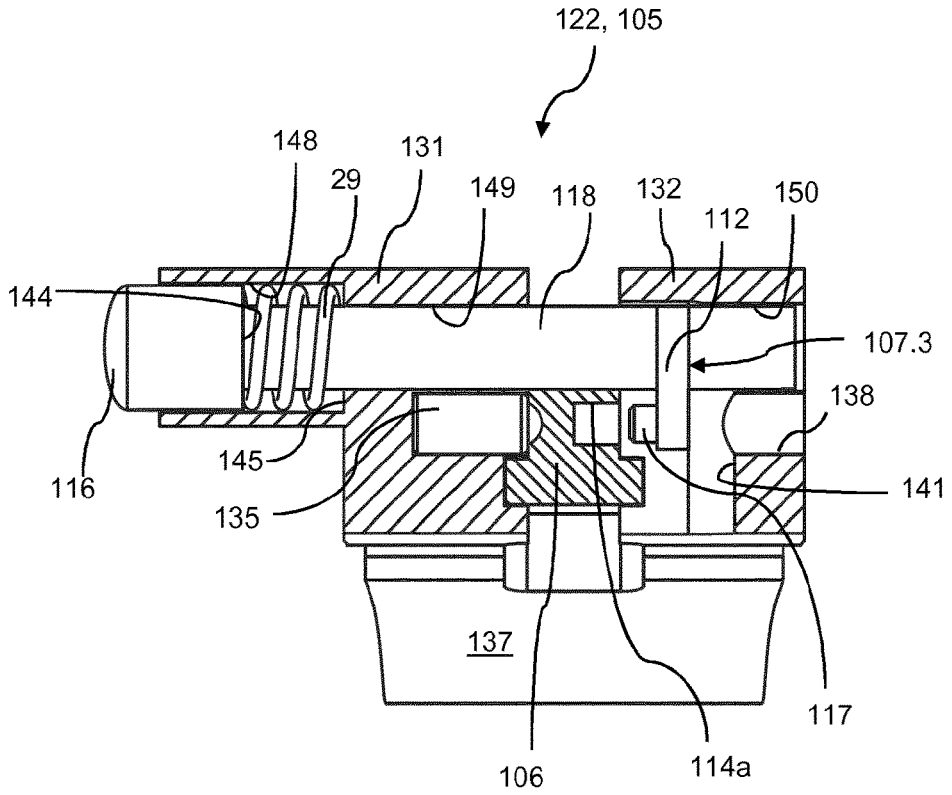

The cylinder 118 of the section following the push member 116 comprises a slightly reduced diameter compared with the diameter of the push member 116. Said cylindrical section 118 can be considered a guiding cylinder 118. The reduced diameter of the guiding cylinder 118 gives rise to the first annular edge 144, formed between the push member 116 and the guiding cylinder 118. The annular edge 144 serves as a bearing surface for the spring 29, as shown in FIGS. 17A and 17B.

The second part 107.2 also includes two portions or first and second coaxial cylindrical sections 119, 120. The free end of the first cylinder 119 comprises a thread for allowing screwing in the tapping arranged in the first part 107.1, especially at the end of same opposite the push member 116. In the second part 107.2, the cylindrical section 120 at the end opposite the threaded portion includes a slightly larger diameter compared with that of the cylinder including the thread, so as to form an annular flange between the two cylindrical sections 119, 120 of the second part.

A locking part 107.3 including a hole having a diameter that matches the diameter of the first section 119 is inserted onto the second part 107.2 in order to be retained at the annular flange of the second part 107.2, when the latter is screwed onto the first part 107.1. The annular flange formed between the first and second cylindrical sections 119, 120 clamps especially against the locking part 107.3 when the second part 107.2 is screwed into the first part 107.1.

The locking part 107.3 includes a locking stem or pin 117, the axis of which is parallel to the axis of the locking pin 107. Indeed, the locking part 107.3 has the function of connecting the locking stem 117 to the pin 107 and of defining the orientation of the stem. The locking stem 117 operates as a blocking structure, making it possible to lock the mobile piece 106 in a longitudinal position defined by the wearer. In addition, the locking part 107.3 includes a plate 112 connecting the hole to the stem 117. This plate, which is the support for the hole in the part and for the stem 117, allows the locking part 107.3 also to operate as an abutment that retains the pin 107 in the housing thereof.

In one embodiment, said locking pin 107 is rigidly connected to a locking stem 117, the axis of which is parallel to the axis of the locking pin 107, and arranged so as to engage with said mobile piece 106 in order to block same and thus to determine a stable adjusted bracelet length.

The housing 131, 132 of the locking pin 107 is formed by two coaxial and orthogonal cylindrical holes, provided on either side of the space 130 arranged between the two side members 108, 109. The holes are arranged in two bulges 131, 132, which emerge on the side members 108, 109 relative to the general upper surface of the second blade 122, i.e. relative to the common surface 19*a*, 19*b*, 19*c* of the blades of the clasp when the clasp is closed. The bulge 131 on the first side member 108 protrudes laterally from the blade 122 and/or the side member 108, to form a housing 148 for the push member 116 of the locking pin. It is the tubular portion 139 of the bulge 131 that protrudes laterally from the blade 122 in an orthogonal direction.

In the embodiment shown, the housing 148 for the push member 116 is a first hollow cylinder, including a side opening, allowing the free end of the push member 116 to protrude, so that the latter can be actuated from the outside by a wearer. The housing 148 is extended by a second hollow cylinder 149 towards the inside of the bulge 131, to form a housing for the guide section 118 of the pin 117. The diameter of the second hollow cylinder 149 is smaller than the diameter of the first hollow cylinder 148, to produce an annular flange 145 inside the recess of the pin 107.

The annular flange 145 forms the second bearing for the spring 29, which acts on the pin 107, by pressing on the annular flange 144 of the push member 116, so that the push member 116 is biased in an orthogonal direction outwards, out of the housing 148 provided laterally on the second blade 122.

In one embodiment, the length-adjustment device 5, 105 includes an actuating member 16, 116, biased by a spring in locked position. The actuating member is preferably rigidly connected to the locking pin 7, 107. In one embodiment, the actuating member is coaxial with the pin 7, 107. In the shown embodiments, the actuating member includes a cylinder provided at the free end of the housing 31, 131.

The pin 107 is retained in the housing thereof by the locking part 107.3 which rests against the mobile piece 106 when the locking device is in the inoperative or inactivated position (FIG. 18A). Specifically, the plate 112 on which the locking stem 117 is arranged abuts with the first side face 156 of the wall 153 of the mobile piece 106, as can be seen in FIGS. 17A and 18A.

The side member 109 also includes holes and cavities to complete the housing of the pin 107 in the second blade 122. The bulge 132 includes a cylindrical hole 150, open towards the outer lateral side visible in FIG. 14. The cylindrical portion 120 of the second part 107.2 is housed in the hole 150. To allow the movement of the locking part 107, an indentation 141 is made in the inner side face of the second side member 109 (FIG. 15).

In one embodiment, the locking pin 107 is arranged so as to pass above said mobile piece 106, in particular above the structure or the frame 153 including the serration 114. The locking structure—i.e. the stem 117 rigidly connected to the pin 107—extends parallel to the pin 107, but on a level below the locking pin 107, in order to be able to engage with the serration. This arrangement is the result of the absence of a longitudinal slot in the mobile piece, as shown in relation to the first embodiment, allowing the pin 7 to pass through the mobile part 6 in this case.

Figure 14:
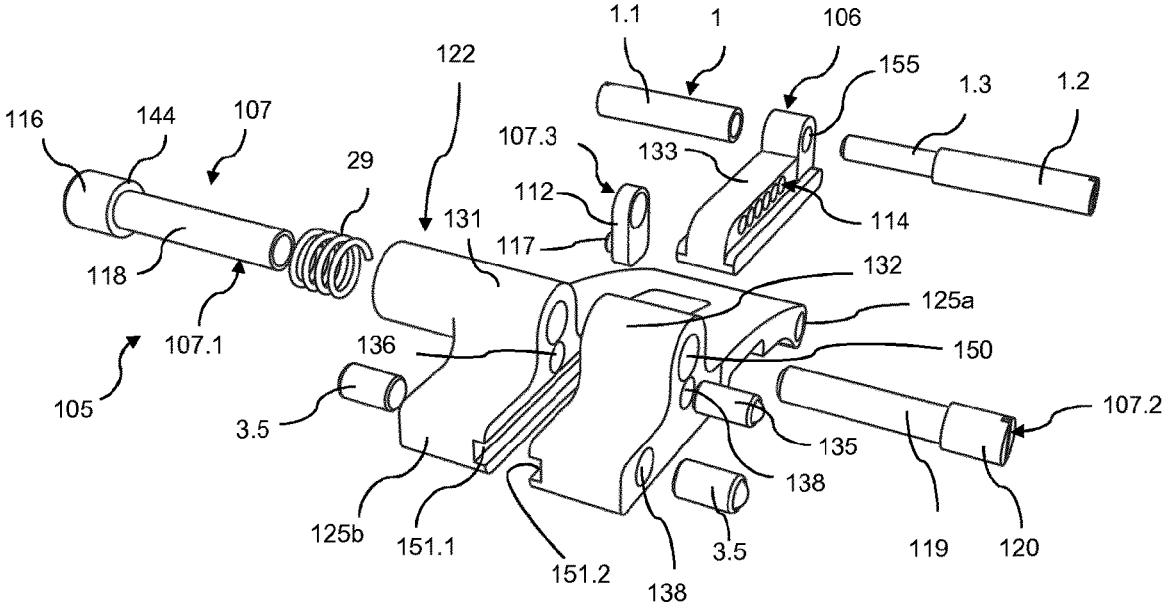
FIG. 14 is a perspective view of the blade including the length-adjustment device of the clasp of FIGS. 10 to 13, the bracelet length-adjustment device being shown in exploded view.
Figure 15:
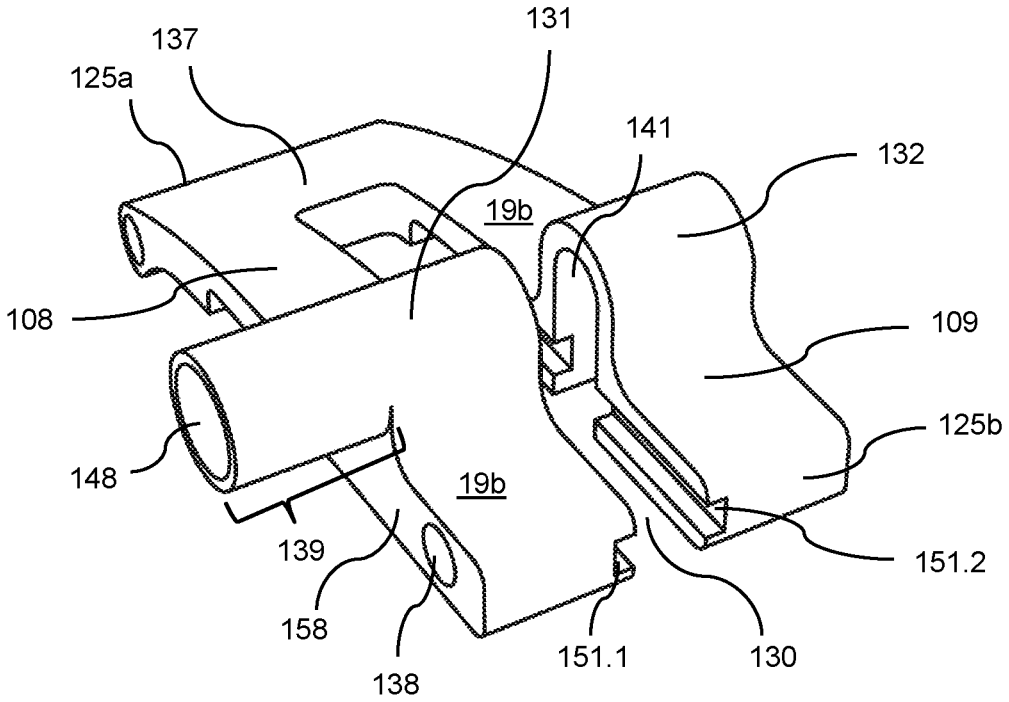
FIG. 15 is a perspective view of the blade including the device for adjusting the length of the clasp of FIGS. 10 to 13.

It should also be noted that the second blade 122 contains a housing 136 for the ball ratchet 135 (FIG. 14). This housing is formed by a non-through cylindrical hole 136, arranged in the inner side face of the first side member 108. In order to allow the positioning of the ratchet 135 in the housing 136 thereof during the assembly of the clasp, a through-hole 138 is bored in the second side member 109, the through-hole 138 being coaxial with the housing 136 of the ratchet, to allow the insertion of the ratchet into the recess 136 in the first side member 108 through the second side member 109.

As in the case of the first embodiment, the locking pin and/or element 7, 107, is intended for being moved axially in order to unlock the adjustment device 5, 105 and allow a length adjustment of the bracelet.

The operation of the length-adjustment device and the locking device thereof will be described hereinafter in reference to FIGS. 17A-18B. The inoperative position or locked position, shown in FIGS. 18A and 19A, is differentiated from the activated position or unlocked position, shown in FIGS. 18B and 19B. In order to finely adjust the length of the bracelet by means of the clasp of the invention, it is convenient to first pass from the locked position to the unlocked position. Indeed, in locked position, the mobile piece is prevented from moving in a longitudinal direction of the bracelet. It should further be noted that the locked position is a stable position, since it is maintained by means of the spring 29. To unlock the length-adjustment device, the wearer is required to apply a pressing force on the push member 116, and preferably to maintain the push member in pressed position, to prevent the locking device from returning to the locked position automatically before the length is adjusted as desired.

As can be seen in FIGS. 17B and 18B, the pressing of the push member 116 by the wearer moves the locking pin 107 along its own axis. Due to this movement, the locking stem 117 exits its recess formed by a hole of the first serration 114. Obviously, the mobile piece 116 is no longer blocked and can be moved in the longitudinal direction, thus modifying the length of the bracelet. It will be noted, however, that the ball of the ratchet 135 is always in a hole of the second serration 115. In order to move the mobile piece, it is necessary for the wearer to apply a force in the desired direction of adjustment. For example, the wearer can grip the mobile piece 106 by holding the bar 1 of the attachment member and pushing or pulling the mobile piece, in the desired direction.

During the movement of the mobile piece 106, the ball of the ratchet 135 will be inserted consecutively into one after the other of the recesses 115*a*-115*f* of the serration 115. The ratchet and the second serration 115 thus operate as an indexing serration which predefines the distinct longitudinal positions in which the mobile piece 106 can be blocked. The second serration is also referred to as "pre-positioning serration" or "indexing serration" of the mobile piece 106. As mentioned in reference to FIG. 16A, the first serration 114 is made up of holes or recesses 114*a*-114*f* separated by a distance. The serration formed by the ratchet 135 and the recesses 115 has the function of halting the mobile piece in the positions in which it can be blocked by the locking pin 107. The absence of the second serration 115 does not make fine adjustment impossible, but its presence makes the length adjustment easier.

It should be noted that the present invention also contemplates a pre-positioning serration for the clasp 10 according to the first embodiment shown in FIGS. 1-14. In this case, the side face 36 of the mobile piece 106 can be provided with recesses along the slot 13. The recesses can preferably be in the shape of hollow half-moons, as in the case of the serration 115. A ball ratchet may be located in the first side member 8, optionally in a housing with orthogonal orientation formed in an appropriate bulge that may be located next to (in longitudinal direction) the bulge 31.

Once the length is adjusted as desired by the wearer, the latter can release the pressure on the push member 116, in order for the locking pin 107 to move, under the effect of the spring 29, to allow the locking stem to be inserted into the corresponding gap of the first serration 114. The stem 117 is inserted precisely into this gap, since the mobile piece 106 has been pre-positioned by the second serration 115 and the ratchet 135. The length-adjustment device will enter an inoperative arrangement as shown in FIG. 18A.

It can be further specified that the mobile piece 106, when unblocked, cannot exit its housing between the side members 108, 109, since the locking pin also operates as a halting structure, against which the lug 154 abuts when a wearer presses the mobile piece towards the opening towards the free end of the two side members 108, 109 (right-hand side of FIGS. 18A and 18B). Towards the opposite end in the longitudinal direction, the travel of the mobile piece 106 is limited by the base 137 of the second blade 122.

Certain special features of the preferred embodiments of the invention will be summarized hereunder. In the clasps shown in the figures, the device for fine length adjustment of the bracelet 5; 105 is associated with an "inner" blade or "second blade" 22; 122, which is arranged so as to be inserted between two side members 21.1, 21.2 of a main blade or first blade 22, when the clasp is closed. In one embodiment, the adjustment device 5; 105 is secured to said second blade 22; 122. This is made possible by the arrangement of at least one portion of the adjustment device 5; 105 above the common surface 19*a*, 19*b* of the blades of the clasp. The second blade 22; 122 includes mainly bulges 31, 32; 131, 132, in which one or more structural elements of the adjustment device 5; 105 are arranged. Thanks to this above-grade arrangement, it is possible to secure and/or connect the adjustment device 5, 105 to the inner blade 22; 122.

Another special feature of the clasps is the fact that said inner blade 22; 122 in turn includes two side members 8, 9; 108, 109, between which the mobile piece 6; 106 is arranged. This also makes it possible to connect the adjustment device to the inner blade. The locking member 7, 107 is preferably housed in a housing arranged on either side of a space formed between the two side members. In other words, a portion of the housing 31, 131 is arranged on a first side member 8, 108, and a second portion of the housing is arranged on the second side member 8, 109.

It can be specified that the actuating member 16; 116, provided to be activated by a user in order to finely adjust the length, is rigidly connected to and preferably coaxial with a locking pin 7; 107 which supports the locking structure 17; 117, arranged to engage with a serration 14, 114 of the mobile piece, in order to allow the locking of an adjusted length and the adjustment of the length after unlocking.

In the embodiments shown, the locking pin 7; 107 has an orthogonal orientation. The bulges 31, 32; 131, 132 include recesses or tubes in which the locking pin is housed. The locking pin 7, 107 can comprise consecutive sections having different diameters, in order to create bearing surfaces, for example, for a spring, and/or to allow the pin to be housed in the housing thereof, to interact with the mobile piece and/or to be connected to an actuating member 16; 116.

The locking pin, including the actuating member and the locking structure 17, 117, can be more generally designated as locking member 7, 107.

In the embodiments shown, the orthogonal arrangement of the pin 7, 107 and the tubes 31, 32; 131, 132 in which it is housed above grade relative to the common surface 19*a*, 19*b* of the first and second blades, coincides with the orthogonal orientation of the first attachment member 1 and/or with the orientation of the tubes housing at least one portion of the locking means 3.4, 3 of the clasp and/or of the second attachment member 2. As can be seen clearly in FIGS. 1, 3, 10, and 12, a plurality of longitudinal sub-assemblies or devices of the clasp are characterized in said orthogonal orientation, said longitudinal sub-assemblies thus being parallel to one another. For example, the locking pin 7, 107 is parallel to the first attachment member 1 and/or to an axis of the latter. According to another example, the pin 7; 107 is parallel to a cylinder 3.4 of the locking means 3.4, for example of the transverse cylinder of the latter. According to one example, the pin 7; 107 is parallel to a tube or a pin 2.4, which is part of the second attachment member 2. According to one embodiment, one or more components chosen among the stem 1 of the first attachment member, the cylinder or the pin 3.4, and the tube or the pin 2.4 are arranged above grade and/or above the common surface 19*a*, 19, (19*c*) of the first, second and, if need be, third blades 20, 22, 23, when the clasp is closed.

The features discussed above give the entire clasp according to the invention an appearance that is both compact and aesthetically pleasing. This applies, in particular, to the clasp with three blades, wherein the two lateral blades 22, 23 support the length-adjustment device 5, 105 and the locking device 3 of the clasp, respectively, and/or the adjustment device 5, 105 and the second attachment member 2, respectively. In one embodiment of a clasp with three blades, the blade supporting the means for locking/closing the clasp is lowered into closed position after the blade supporting the length-adjustment device when the clasp is closed. The third blade 23 is preferably arranged to block and/or lock the second blade when the third blade, supporting the locking means 3, is placed in the closed position.

In one embodiment, the mobile piece 6 is pivotably mounted on the blade 22 supporting the length-adjustment device 5. This special feature can also be carried out in a clasp having a different configuration, for example supporting the adjustment device 5 on the main or "outer" blade 20. In the embodiment shown, the locking member 7 or a portion 15 of the latter operates as a pivoting pin for the pivotably housed mobile piece. This is made possible, for example, by a longitudinal slot 13 provided in the mobile piece, and/or the arrangement of the recesses of a toothed/serrated portion 14 along and/or directly adjacent to said slot.

In one embodiment, an axis of said locking pin 7 constitutes the pivoting axis of said mobile piece 6.

A person skilled in the art will also observe that, due to the guiding of the locking pin 7 through a slot in the mobile piece 6, the pin 7 is arranged at a lower height (in the direction of a vertical axis) than in the case of the embodiment shown in FIGS. 10-18B, or the locking pin 107 passes above the mobile piece 106. For this reason, the first blade 20 of the clasp of the embodiment of FIGS. 1-9B can have cavities 39.1, 39.2, for receiving at least one portion of the housing of the locking pin when the clasp is closed. More precisely, the cavities can receive lateral extensions 33, 34, preferably tubular, of the housing of the locking pin 7. Even if, in this case, the pin 7; 107 is positioned less above grade relative to the general plane of the clasp, the axis of the pin 7; 107 preferably remains above the common surface 19*a*, 19*b* of the first and second blades.

One difference of the embodiments shown in FIGS. 1-9B and 10-18B, respectively, is that in the first case, the locking pin 7 and the locking structure 17 are in the same horizontal plane (FIGS. 9A-9B), while in the second case, the locking structure 117 is not arranged in the same horizontal plane as the locking pin 107.

In the first case, the locking pin 7 and the locking structure 17 are preferably coaxial. For example both of these components 7, 17 or at least one of the two are cylindrical. In the second case, the axis of the pin 107 is preferably parallel to the locking stem 117.

A person skilled in the art will not find any particular difficulty in adapting the content of the present disclosure to his or her own specific needs and implementing a clasp, in particular for a timepiece, without departing from the scope of the present invention. As mentioned, the length-adjustment device according to the invention can be adapted to other types of clasps, especially for a wristwatch.

The invention claimed is:

1. An extensible buckle clasp for a bracelet allowing an adjustment of a length of the bracelet, said clasp including:

a first blade and a second blade, hingedly connected relative to one another at a first end, the first blade including two side posts between which a space is formed adapted to receive said second blade when the clasp is in a closed position;

locking means making it possible to maintain said first and second blades in said closed position;

a length-adjustment device for adjusting the length of the bracelet, said length-adjustment device including a locking element, a housing for the locking element, and a mobile piece to which a first at member is secured, said attachment member being intended for being connected to a first free end of the bracelet;

wherein said length-adjustment device is connected to said second blade, which is arranged to be received in said space formed between said side posts of said first blade when the clasp is in a closed position, and wherein said mobile piece is pivotably mounted on said second blade.

2. The clasp according to claim 1, wherein said housing for said locking element is arranged so that at least one portion of the locking element is located above said first blade when the clasp is in a closed position.

3. The clasp according to claim 1, wherein said housing of said locking element protrudes from the general upper surface of said second blade.

4. The clasp according to claim 1, wherein said locking element is a locking pin, housed so that the axis thereof is located above the plane formed by the common upper surface of said first and second blade.

5. The clasp according to claim 1, wherein said second blade includes first and second side members, the mobile piece being arranged between said side members, a first portion of the housing of the locking element being arranged in a bulge of said first side member, and a second portion of the housing being arranged in a bulge of said second side member.

6. The clasp according to claim 1, wherein said locking element is placed in a direction orthogonal to the length direction of the bracelet and/or intended for being moved axially in order to unlock the length-adjustment device and to allow an adjustment of the bracelet length.

7. The clasp according to claim 1, wherein said housing of said locking element protrudes laterally, in a direction orthogonal to the length direction of the bracelet, from a flank of said second blade, in order to be located above said side posts of said first blade when the clasp is in a closed position.

8. The clasp according to claim 1, wherein one end of said locking element emerges through a lateral opening of the housing, said end being arranged to form an actuating member of the length-adjustment device.

9. The clasp according to claim 1, wherein said locking element is a pin and/or a locking stem and in that an axis of said locking pin constitutes the pivoting axis of said mobile piece.

10. The clasp according to claim 1, wherein said mobile piece includes a longitudinal slot with said locking element passing therethrough.

11. The clasp according to claim 1, wherein said mobile piece includes a serrated portion formed by a series of recesses passing partially through the mobile piece, so as to create, inside the mobile piece one or more bearing surfaces against which a locking structure abuts when the length-adjustment device is in a blocked position.

12. The clasp according to claim 1, wherein said mobile piece includes a first serrated portion including a first series of recesses, provided along said mobile piece and intended for engaging with a locking stem, and in that said mobile piece includes a second serrated portion including a second series of recesses, intended for engaging with a ratchet arranged to position the mobile piece in an indexed position when the length-adjustment device is unlocked.

13. The clasp according to claim 1, wherein said mobile piece includes a seat slidably housed in said second blade and a structure above grade relative to said seat, said first and second serrated portions being provided on either side of the opposing surfaces of said structure.

14. The clasp according to claim 1, wherein said locking element is arranged so as to pass over said mobile piece.

15. A bracelet clasp for bracelets of the type comprising first and second free ends, the clasp including first and second attachment members of the bracelet intended for being connected to said first and second free ends, respectively, of the bracelet, said attachment members being movable relative to one another between at least one open position and a closed position, of service, wherein said free ends are closer to one another than in the open position, the clasp comprising:

locking means that make it possible to open and close the clasp;

a first support having a length-adjustment device for adjusting the length of the bracelet, said length-adjustment device including a mobile piece to which one of the two attachment members is secured, wherein said mobile piece is pivotably mounted on said first support, wherein said locking element includes a bulge with a shape that complements the shape of one of the recesses of a serrated portion arranged in the mobile piece along said longitudinal slot.

16. The clasp according to claim 15, wherein said support includes two side members, separated by a central longitudinal opening, and in that said mobile piece is provided so as to pivot in said central opening.

17. The clasp according to claim 15, wherein said length-adjustment device includes a locking element including a narrower section and in that the size of the narrower section substantially matches the height of a longitudinal slot arranged in the mobile piece and allowing the locking element to pass through said longitudinal slot.

* * * * *